US011267541B1

(12) United States Patent
Appell

(10) Patent No.: US 11,267,541 B1
(45) Date of Patent: Mar. 8, 2022

(54) ENHANCED SURFBOARD AND SURFBOARD TRACTION PAD

(71) Applicant: Thomas Edward Appell, Coto De Caza, CA (US)

(72) Inventor: Thomas Edward Appell, Coto De Caza, CA (US)

( * ) Notice: Subject to any disclaimer, the term of this patent is extended or adjusted under 35 U.S.C. 154(b) by 0 days.

(21) Appl. No.: 17/489,658

(22) Filed: Sep. 29, 2021

Related U.S. Application Data

(63) Continuation-in-part of application No. 17/373,099, filed on Jul. 12, 2021.

(51) Int. Cl.
*B63B 32/73* (2020.01)

(52) U.S. Cl.
CPC ..... *B63B 32/73* (2020.02)

(58) Field of Classification Search
CPC ..... B63B 32/73; B63B 32/45
See application file for complete search history.

(56) References Cited

U.S. PATENT DOCUMENTS

| | | | | |
|---|---|---|---|---|
| 5,308,271 | A * | 5/1994 | Foulke | B63B 32/70 441/74 |
| 5,484,312 | A * | 1/1996 | Zepeda | B63B 32/45 441/74 |
| 6,193,276 | B1 * | 2/2001 | Sottile | A63C 17/01 280/816 |
| 2003/0124923 | A1 * | 7/2003 | Mercer | B63B 32/70 441/74 |
| 2014/0144050 | A1 * | 5/2014 | Smith, III | A43B 13/00 36/137 |

* cited by examiner

*Primary Examiner* — Stephen P Avila

(57) ABSTRACT

An enhanced surfboard and surfboard traction pad comprising permanent or interchangeable and detachable bases and/or top pieces that extend up, over and behind the leash pin in a uniquely designed surfboard optimally shaped for mounting said traction pad, or a regular surfboard modified to fit said traction pad. Said traction pad can be configured to have a ramped face, and optionally a ramp to a vertical face and a ramp to a vertical and angled, curved or horizontal overhang that creates a pocket for the surfer's foot to push the tail of the surfboard back with the outside edge of the rear foot against the vertical face of the traction pad or lift the tail end of the surfboard up by pressing with the top of the rear foot against underside of said overhang for aid in executing aggressive turns and aerial manuevers.

20 Claims, 40 Drawing Sheets

Traction Pad Base & Interchangeable Top Piece
Horizontal Overhang
Multiple Piece Traction Pad
Front Perspective View Traction Pad Base & Interchangeable Top Piece With Overhang
Multiple Piece Traction Pad
Rear Perspective View Traction Pad Base
Interchangeable Top Piece With Overhang
Side View One Piece Traction Pad Base With Overhang
Side View Traction Pad Base
Interchangeable Top Piece With Angled Overhang
Multiple Piece Traction Pad
Front Perspective View Left and Right Traction Pad Base
Angled Overhang
Multiple Piece Traction Pad
Front Perspective View Traction Pad Base
Top Piece With Angled Overhang
Side View One Piece Traction Pad Base With 45° Overhang
Side View One Piece Traction Pad Base
Vertical Face
Multiple Piece Traction Pad
Front Perspective View One Piece Traction Pad Base
Vertical Face
Side View Traction Pad Base
Vertical Face and No Overhang
Multiple Piece Traction Pad
Rear Perspective View Traction Pad Base
Interchangeable Top Piece
Horizontal Overhang
Multiple Piece Traction Pad
Front Perspective View One Piece Traction Pad Base With Horizontal Overhang
Multiple Piece Traction Pad
Front Perspective View One Piece Traction Pad Base With Angled Overhang
Multiple Piece Traction Pad & Mounting Bolt Detail
Front Perspective View Top Piece Ankle Cut Out Options With Horizontal Overhang
Top View Top Piece Ankle Cut Out Options With Horizontal Overhang
Top View Top Piece Tounge, Groove With Two Rear Screws
Vertical Top Piece
Rear Cut View Top Piece Tounge, Groove With Two Rear Screws
Rear Cut View Traction Pad Base & Interchangeable Top Piece
Angled Rear Screw Fasteners
Side View Traction Pad Base & Interchangeable Top Piece With Two Rear Screw Fasteners
Side View Traction Pad Base & Interchangeable Top Piece Cap
Multiple Piece Traction Pad
Front Perspective View Left & Right Piece Traction Pad Base
Vertical Face
Three Piece Traction Pad
Front Perspective View Left & Right Piece Traction Pad Base
Vertical Face
Arched Ramp
Three Piece Traction Pad
Front Perspective View Left and Right Traction Pad Base
Left and Right Interchangeable Top Piece
Horizontal Overhang
Multiple Piece Traction Pad
Front Perspective View Left and Right Traction Pad Base
Left and Right Interchangeable Top Piece
Horizontal Overhang
Multiple Piece Traction Pad
Front Perspective View Arched Base Bottom
Rear Cut View Left and Right Traction Pad Base
Angled Overhang
Three Piece Traction Pad
Front Perspective View Left and Right Traction Pad Base
Detachable Top Piece
Angled Overhang
Five Piece Traction Pad
Front Perspective View Two Piece Traction Pad Base
Interchangeable Vertical Top Piece
Five Piece Traction Pad
Front Perspective View Traction Pad Base
Interchangeable Top Piece
Curved + Horizontal Overhang
Side View Traction Pad Base
Interchangeable Top Piece
Curved Overhang
Side View One Piece Traction Pad Base
Ramp to Horizontal Top
Two Piece Traction Pad
Front Perspective View Two PieceTraction Pad Base
Ramp To Horizontal Top
Three Piece Traction Pad
Rear Perspective View Traction Pad Base
Interchangeable Top Piece With Angled Overhang
Tongue and Groove Connection
Exploded Rear Perspective View

ENHANCED SURFBOARD AND SURFBOARD TRACTION PAD

BACKGROUND OF THE INVENTION

The present invention pertains to surfboards. The upper surface of the surfboard is referred to as the deck. The outside edge of the surfboard sides are referred to as the rails. The back wherein the fins reside on the underside is referred to as the tail. Surfboards have a leash pin hole with a pin for attaching a leash near the tail on the deck.

Most surfers prefer shorter surfboards which are capable of much more aggressive turning than longer surfboards. Surfers stand on the deck with one foot planted near the tail (rear) and the forward (front) foot planted nearer the front of the surfboard. It's easiest to turn a surfboard when the rear foot is at a strategic position very close to the tail. Current surfboard traction pads, which have a narrow, raised section at the back, typically angled up at 45°, are affixed to the surfboard deck near said strategic position and are used by surfers so they can "feel" with their foot where the back of the surfboard is and execute a good turn. Traction pads also aid with helping the surfer to not slip off of the surfboard. The traction pad raised area at the back gives limited support for the surfer to push the back of the board when executing a turn.

The top of the surfboard in front of the traction pad is either covered with wax or additional traction pads to prevent the surfer from slipping. U.S. Pat. No. 4,840,590 is an example of this. These designs help the surfer from slipping off of the surfboard. However, when attempting an aggressive turn or aerial maneuver, it's very difficult for the surfer to maintain a secure point of contact with the surfboard deck because there's nothing holding the surfer's foot to the board, and it's easy to fall off.

Other designs for surfboards which allow the surfer to secure a point of contact with the surfboard and lift the surfboard with the feet include a foot piece in which the surfer's foot can be placed. An example of such a design is U.S. Pat. No. 5,484,312. The problem with this and similar designs is that the foot piece is located in the area where the surfer needs to lay down to paddle. This obtrusive foot piece makes paddling uncomfortable. Also, this foot piece is not located on the tail where the surfer's rear foot needs to be secured. Thirdly, this foot piece is intended for using the inside of the surfer's front and back feet to press against and provide stability which is not what surfers are used to doing. Surfers use the outside of the rear foot to press against the traction pad, provide stability, and help with "pushing" the back of the board through the lip of the wave to help execute a smooth turn.

The problem with existing surfboard traction pads is that the rear of the pad is too far forward for the surfer to place their rear foot far enough back to be in a strategic and optimum position to execute a really good tight turn, front (surfer facing the wave) or backside (surfer's back facing the wave) snap. Snaps are very aggressive turns executed as the surfer makes a bottom turn, then goes straight up the face of the wave, ideally with the surfboard perpendicular to the wave, and turns very quickly about 180 degrees at the top of the wave sending a spray of water out like a rooster tail. Snaps are easier to do if the rear foot is as far back as possible. Existing traction pads are limited in how far back they can be placed, because they can't be placed over the leash pin hole embedded in the surfboard. The workaround has been to cut out a portion of the pad so the pad can be placed a little further back, but it still places the rear of the pad in front of the leash pin hole and quite a ways in front of the tail end of the surfboard. Typically surfers are forced to straddle the back of the traction pad and the surf leash to get their foot in the best position for a snap. It's awkward and doesn't feel great under their feet.

Also, the surfer's rear foot is resting on the traction pad with no way to secure said foot to said traction pad. When performing an aerial maneuver or snap or even a simple turn it's easy for the surfer's rear foot to become disengaged from the surfboard traction pad and the surfer falls off. Also, it's easy for surfers to fall off while attempting to push the tail of the surfboard back with their foot, which is common to do when attempting a snap or other aggressive maneuver using current traction pads having a raised area that's angled at 45° and raised just a small amount, typically an inch. The ramped area at the back of a current traction pad is much narrower than a human foot so the surfer always feels like their foot does not have great connection to the surfboard.

Also, existing surfboard traction pads have a narrow rear end, and only display the product name on the face of the traction pad where the surfers stand, not utilizing the rear of the pad for any product branding.

U.S. patent application Ser. No. 17/373,099 shows a foot pocket integrated with a traction pad for a surfboard that can be vertical, or have an overhang allowing the surfer to push back or lift up the tail end of the surfboard with the rear foot. The present invention comprises an enhanced surfboard traction pad which includes the foot pocket design of U.S. patent application Ser. No. 17/373,099 while adding additional design improvements over existing surfboard traction pads and the foot pocket design noted in U.S. patent application Ser. No. 17/373,099 and includes a surfboard designed to integrate with said enhanced surfboard traction pad.

The enhanced surfboard traction pad is comprised of a rigid base strong enough to go up, over and behind the surfboard leash pin hole and back far enough to give the surfer the advantage of being able to place the outside edge of the rear foot behind the leash pin hole and closer to the tail end of the board which allows for greater ease in executing sharp turns, front and backside snaps.

Because said traction pad extends up, over and behind the leash plug, the design includes a wide ramp area for the surfer to stand on which helps the surfer stay connected to the surfboard and execute more aggressive maneuvers without falling.

Said traction pad can be configured with a one piece base or as a base and detachable top pieces which can have different configurations to suit the needs of different surfers. The base can have a horizontal back at the top of the ramp area, a vertical back allowing surfers to push the tail end of the board out of the water for aggressive maneuvers, or a vertical back with a curved, angled or horizontal overhang of any length which allows surfers to lift the tail of the surfboard out of the water for aerial maneuvers.

Said traction pad can mount to the deck of the surfboard with a flat or arched mounting plate allowing the bases to be interchangeable as well as the top pieces. Said mounting plate can be integrated with a surfboard leash pin and associated housing to hold said leash pin, eliminating the need for a separate leash pin and housing to be installed in the surfboard.

Said traction pad can be configured with a large area at the back of the base and top of any of the top pieces where branding logos can be placed.

An enhanced surfboard with a new design optimized for mounting the enhanced surfboard traction pad to said surfboard deck is included as part of this invention.

SUMMARY OF THE PRESENT INVENTION

The traction pad part of the present invention, also known as an enhanced surfboard traction pad comprising: a base which may be one piece 27, 30, 38, 58, 77 or a one piece base 1 with detachable top pieces 2, 34, 59 that are interchangeable, or a two piece base with a horizontal overhang 56, 57 a vertical face 53, 54, an angled overhang 62, 63 or a ramp going into a horizontal back 78, 79 or a two piece base 51, 52 with interchangeable, detachable top pieces 49, 50, 64, 65, 66, 67, with traction pad material affixed to the front of said bases 1, 27, 30, 38, 53, 54, 56, 57, 58, 62, 63 and top pieces 2, 34, 49, 50, 59, 64, 65, 66, 67 with said traction pad material extending forward from the base towards the nose of the surfboard 7, 87 and affixed to the surfboard 7, 87 with adhesive.

For enhanced surfboard traction pad configurations with interchangeable top pieces, said top pieces will attach to the base by sliding a tongue 60 into a groove 45 secured with a screw 5 that screws into a horizontal 46 or angled 26 and threaded shaft from the back of the base into a notch 82 in the tongue of the top piece.

EVA rubber foam or some other suitable material with a surface manufactured for making the traction pad easy to grip with the surfer's foot without slipping, hereinafter called traction pad material 3, is to be permanently affixed using glue or any suitable permanent adhesive to the front of the base and/or top piece that will come into contact with the surfer's foot. This traction pad material will extend forward towards the front of the surfboard 80, 81, affixed to the surfboard with adhesive, as far as is needed to provide optimum traction for the surfers rear foot while surfing 3.

The enhanced traction pad will be affixed at the tail end of the surfboard 7 slightly in front of the leash pin hole 31. 11 shows a representation of the preferred embodiment. The enhanced traction pad can have a ramp 4 going to a horizontal top 77, 78, 79, a ramp going to a vertical face 30, or a ramp going to a vertical face with an overhang of any length that's curved 69, 70, angled 34, 38, or horizontal 2, 56, 57, 58 that allows the surfer to lift the tail of the surfboard using only the back foot. The enhanced traction pad can have a curved 41, 42 or angled 40, 43 cut out for the surfer's ankle of optimum configuration to allow freedom of movement of the surfer's ankle while surfing.

The enhanced surfboard traction pad provides the advantages of having the ramp area 4 going up, over and behind the leash pin hole in the surfboard deck, allowing the surfer's foot to be planted in an optimum position to execute front and backside snaps and sharp turns. It also has the advantage of having an overhang for lifting the tail end of the surfboard out of the water 29, 36 out of the way of where the surfer needs to lay for paddling, provides maximum push and lifting options for the surfer at the tail end of the board by utilizing only the back foot, keeps the front foot free to move to wherever is best for any maneuver, and allows the back foot to be easily removed from the overhang area 29, 36 when falling or paddling.

The base 1, 27, 30, 38, 53, 54, 56, 57, 58, 62, 63, and top pieces 2, 34, 49, 50, 59, 64. 65, 69, 70, 71 of the enhanced surfboard traction pad would be made of material of sufficient density and rigidity to withstand pressure from the surfer's foot without breaking, preferably EVA rubber foam, nylon or plastic, but also exhibiting optimal flexibility, and the inside area that would be touching the surfers foot lined with traction pad material 3 which continues out in front of the base acting as an integrated surfboard traction pad 3. Said traction pad material can be a single piece or multiple pieces in any configuration 3, 80, 81.

The traction pad material 3 would be permanently affixed to the base and areas of the enhanced surfboard traction pad that will come into contact with the surfer's foot including the front, underside of overhang 29, 36 and top surface 12 of the enhanced surfboard traction pad with adhesive. The enhanced surfboard traction pad base is to have a cut-out 11 for the leash pin hole 31 so said traction pad may be placed as far towards the tail end of the surfboard as is possible.

The enhanced surfboard traction pad base 1, 27, 30, 38, 53, 54, 56, 57, 58, 62, 63 and/or top pieces 2, 34, 49, 50, 59, 64. 65, 69, 70, 71 can be a single piece of molded material or comprise several layers of material such as EVA foam glued together.

Most surfboards decks are higher in the center and slope down at a slight angle from the center. For this reason, when mounting an enhanced surfboard traction pad with a single piece base 1, 38, 58, 77, extra layers of fiberglass should be added to the surfboard deck and the center sanded flat under said base 1, 38, 58, 77. Another option is for the surfboard 87 to be initially shaped with a flat or arched area where the base 1, 38, 58, 77, 85 with a respective flat or arched bottom is to be installed so the adhesive will have the maximum surface area to adhere to. A surfboard 87 initially shaped with said flat area where the base is to be installed is termed herein as an enhanced surfboard 87.

An alternative to planing the surfboard deck or shaping the surfboard to be flat under the base is for the base 51, 52, 53, 54, 62, 63, 78, 79 to be divided into a left 51, 53, 62, 78 and right 52, 54, 63, 79 half, so each base half can follow the slope of the surfboard deck 32. In such designs where the base is divided into left and right halves, the top pieces in a detachable design would also need to be divided into left and right halves 49, 50, 53, 54, 64, 65, 78, 79.

For adhesive installations, the bottom of the base and traction pad material extending out from the front of the base can be pre-coated to the base surface along it's entire surface with adhesive, and be part of the manufactured device. Many synthetic bonding agents and adhesives are available and suitable for the application of this adhesive.

Because the adhesive layer has tackifying characteristics which result in it's adhesion to the surfboard deck upon contact, it's preferable that layer of coating be protected, prior to use, from adhesion to an undesired surface by some protective means. In the preferred embodiment the protective means is comprised of a paper with it's waxed surface in contact with the coating area and being waxed so as to provide ease of removal of the paper, such as peeling off action. Upon removal of the protective paper the adhesive is fully exposed and ready for adhesion to the desired surface.

In order to mount the enhanced surfboard traction pad to the deck of the surfboard, 7, 87 in adequate fashion so it does not dislocate from the deck upon use, the surface of the deck must be suitably prepared. It's necessary to remove any interfering fluids and substances, such as sand, oil and wax, which are on the portion of the deck where the foot anchor is to be mounted. Removal can be accomplished by a number of ways known in the art, such as cleaning, scraping or by applying a suitable solvent such as acetone.

Upon this preparation the enhanced surfboard traction pad is ready to be mounted to the surfboard. The protective paper is removed, and the base surface of the enhanced surfboard traction pad is positioned relative to the location where the mounting is to occur. The protective layer is removed exposing the adhesive layer for contact with the surfboard deck. Pressure is then applied in sufficient amount to secure the bonding of the adhesive to the board. In order to adequately assure the completeness of the bonding, it's recommended that before use a sufficient waiting period be undertaken after pressing the adhesive to the deck.

Once the adhesive has had time to cure and the base and traction pad material is securely attached with adhesive, the enhanced surfboard traction pad is ready for use.

An additional method of securing the enhanced surfboard traction pad to the surfboard is by using an arched 88, 95 or flat 83, 90 mounting plate, which is permanently affixed to the surfboard deck with adhesive. Said mounting plate has threaded barrels 84 that protrude up from said plate that are aligned with mounting holes 15 in the enhanced surfboard traction pad base 1, 27, 30, 38, 53, 54, 56, 57, 58, 62, 63, 77, 78, 79 which can have a bottom that is flat or arched for a flush fit with said flat or arched base through which mounting screws 39 are screwed in to said threaded barrel. Is such embodiments where a mounting plate is used to attach the base, said base is detachable and interchangeable with other bases with the advantage of being able to quickly change configurations to suit the surfer's needs. In such embodiments where the base 1 is permanently affixed with adhesive and designed for use with a top piece such as 2, 34, 59, said top piece is detachable and interchangeable with other top pieces with the advantage of being able to quickly change configurations to suit the surfer's needs.

The screws 39 used to mount said enhanced surfboard traction pad to the mounting plate, preferably would be made of some material that would not be adversely affected by exposure to salt water, such as nylon or stainless steel. The location of mounting holes 15 and threaded barrels 85 may be placed wherever is most convenient to achieve a firm and secure connection of the enhanced surfboard traction pad to the surfboard deck. Two mounting holes and threaded barrels are shown in the present embodiment but any number of mounting holes and barrels needed for a secure connection can be used.

If the enhanced surfboard traction base is permanently glued to the surfboard deck, and for mounting with a mounting plate 83, 88 it may be desirable to have a cut 74 in the traction pad material 3 so the traction pad material in front of the base 1 may be easily removed and replaced if it becomes worn or damaged from surfing.

The enhanced surfboard traction pad can be manufactured with traction pad material that is one piece 80 extending from the top of the base 1 to the front of said traction pad or for ease of affixing to the surfboard, it can be manufactured with multiple pieces 81 abutting together extending from the top of the base 1 to the to the front of said traction pad.

It should be noted that because of the unique design of the enhanced surfboard traction pad, the enhanced surfboard traction pad can be mounted back far enough for the outside of the surfer's rear foot to be securely planted on top of and behind the leash pin hole in the surfboard, but it can be mounted as far forward as is desired. For the first time surfers can choose to have the traction pad area of their surfboard go back farther than ever before, or not.

There can be a cut-out area 35, 40, 41, 42, 43 for the surfer's ankle to be able to have more range of motion without being constrained by the overhang 29 at the front of the enhanced surfboard traction pad. Said cut out can be of any length or shape, curved or angular.

Surfers enjoy being stylish by riding bright colored surfboards of many colors. For this reason, the enhanced surfboard and surfboard traction pad can be of any color or combination of colors that would be suitable for complementing the look of any manufactured surfboard, and also be manufactured in different sizes to accommodate feet of different sizes.

The rear of the enhanced surfboard traction pad has a vertical surface 12 upon which a product name, branding and/or advertising message can be displayed. Said product name, branding and/or advertising message may be carved or molded into the rear end of said foot pocket and/or stamped on with permanent ink, or a silicone heat transfer logo or message may be affixed with adhesive. Said message may be any number of words in any language with or without an accompanying logo or graphic design.

Currently designed surfboard 7 decks have an arched center with a gentle curve sloping towards the rails and are not suitable for mounting the enhanced surfboard traction pad without modifications to the deck of said surfboard. A base with an arch 61 or two piece base such as 51, 52, 53, 54, 56, 57 can be used to help ease the modifications that need to be made to said surfboard 7 for an enhanced traction pad to be securely mounted, but the preferred method of mounting is to have a surfboard deck initially shaped 87 for mounting said traction pad. For this reason an enhanced surfboard 87 is presented herein with a new design featuring a flat or arched area 85 on the surfboard deck near the leash pin hole 31 where the base 1 and/or mounting plate 83, 88, 90, 95 can be mounted, and a transition area 86 from flat or arched to a curved surfboard deck surface.

Also, all present day surfboards are construction with a leash pin 91 and housing for said leash pin at the tail end of the board to which a surf leash 94 is attached between the ankle of the surfer and the leash pin 91, so the surfer can easily retrieve the surfboard after falling. Installing a leash pin housing and leash pin 91 is a time consuming process, and sometimes the housing is pulled out of the surfboard by the force of a wave pulling on the leash 94 after a surfer falls. For this reason, as part of the enhanced surfboard and surfboard traction pad, mounting plate 90, 95 which has an integrated leash pin housing 92, 96 and leash pin 91 can be used when constructing a surfboard 87 optimized for use with an enhanced surfboard traction pad.

Said integrated leash pin housing can be permanently affixed to the mounting plate, preferably cast as a one-piece unit, but can be manufactured separately and affixed to the mounting plate with adhesive. Having the mounting plate integrated with the leash pin housing 92, 96 and leash pin 91 is advantageous because not only does using said mounting plate 90, 95 and integrated surfboard leash pin housing 92, 96 and leash pin 91 save time in constructing the surfboard, it provides a stronger connection between the surfboard 87 and the leash pin housing 92, 96 because of the large surface area of the mounting plate that is affixed to the surfboard with adhesive, and minimizes the chance of the leash pin housing 92, 96 pulling out of the surfboard 87 from the force of a wave pulling on the leash 94 which is attached to said leash pin 91.

These embodiments are not limited to the specific embodiments mentioned above and other forms of the invention are within it's spirit and scope as set forth in the claims hereafter.

DETAILED DESCRIPTION

Figure 1:
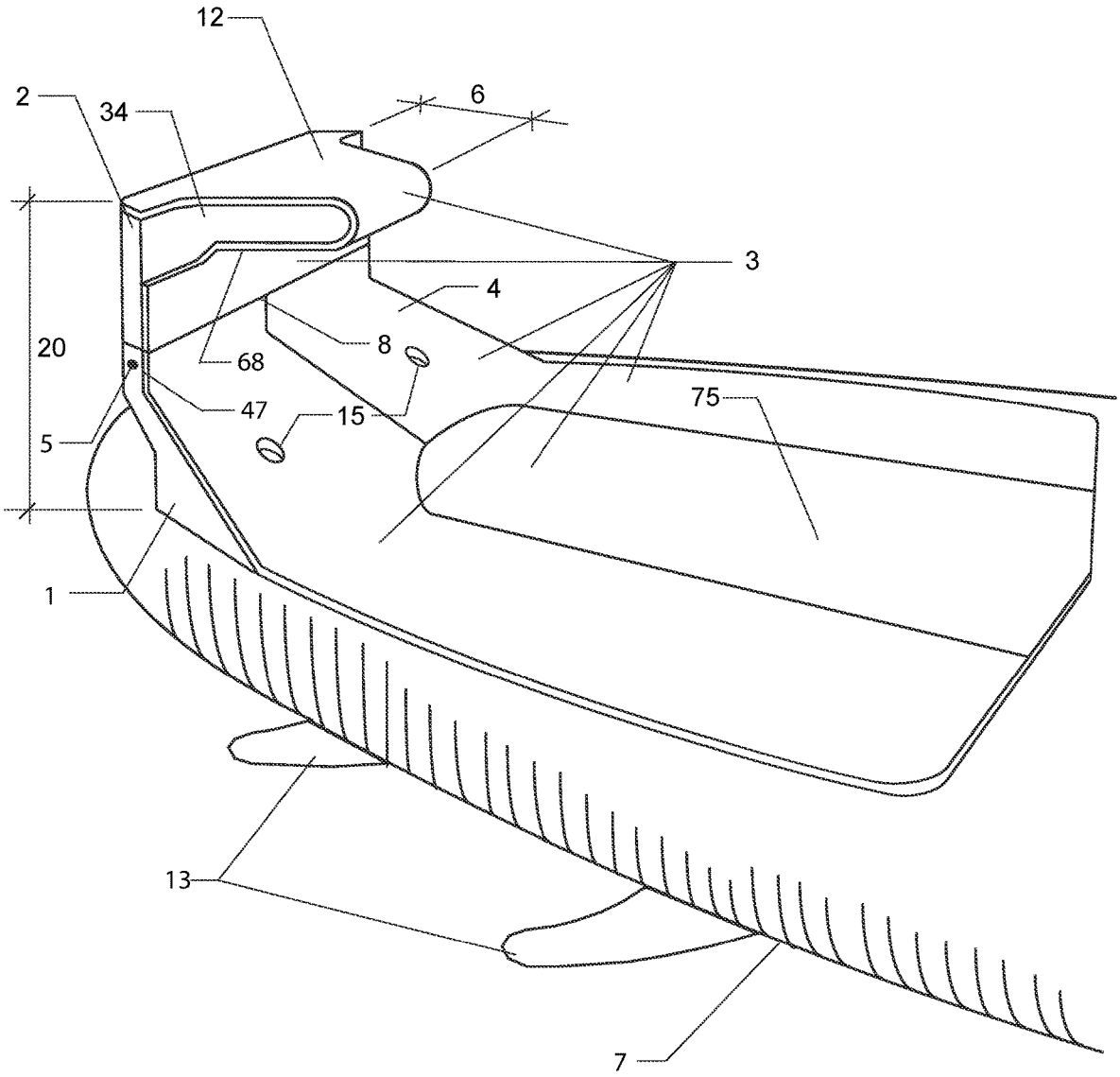
FIG. 1 is a perspective view of a 7 surfboard equipped with an enhanced surfboard traction pad with a one piece base 1 and a detachable top piece 2 featuring a horizontal overhang and a three piece traction pad (two pieces 3 attached to the base and one piece 3 attached to the top piece).

Various terms used herein are intended to have particular meanings. Some of these terms are defined herein for the purpose of clarity. The definitions given below are meant to cover all forms of the words being defined (e.g. singular, plural, present tense, past tense). If the definition below diverges from the commonly understood and/or dictionary definition of such term, the definitions below control.

Embodiments described herein include a surfboard and an enhanced surfboard traction pad comprising a permanently mounted or detachable and interchangeable base and/or detachable top piece with traction pad material 3 affixed for attachment to the tail end of a surfboard deck 32. The enhanced surfboard traction pad described herein advantageously provides a pocket 68 for the surfer's foot so the surfer may push back or lift up the tail end of the surfboard with the rear foot while maintaining a secure rear foot point of contact with the surfboard. The traction pad material 3 has a surface that is easy to grip with the surfers rear foot and is permanently affixed to the front side of the base 1, 27, 30, 38, 53, 54, 56, 57, 58, 62, 63, 77, 78, 79 and top piece 2, 34, 59, 70, 71 and extends forward onto the surfboard deck 32 for the surfer to stand on while surfing.

The enhanced surfboard traction pad can be made with or without a cut-out for the surfers ankle 35, 40, 41, 42, 43 to allow greater freedom of movement of the surfer's leg. The enhanced surfboard traction pad features a flat bottomed base for attachment to the deck of the surfboard 87 by adhesive or by means of a mounting plate with 90, 95 or without 83, 88 an integrated leash pin housing and leash pin. and screws 39 screwing into said mounting plate through holes 15. The enhanced surfboard traction pad can be of any color or combination of colors. The enhanced surfboard traction pad is for surfers surfing with the left or right foot at the rear end of the board.

Referring to FIG. 1, a perspective front view of a surfboard 7 is shown equipped with an enhanced surfboard traction pad with a base 1 and a detachable top piece 2 featuring a horizontal overhang and a three piece traction pad. The top piece shown with a horizontal overhang may be removed and replaced with a top piece with a longer or shorter overhang, an angular overhang of any length 38, or a top piece with only a vertical face 30 of any height. To accommodate said traction pad, the deck 32 of the surfboard 7 must suitably modified by creating a flat surface under where said traction pad is to be installed, preferably with extra layers of fiberglass sanded flat as needed so the flat bottom of the base 38 will be flush with the surfboard deck so adhesive between the bottom of the base 38 and the deck 32 of the surfboard 7 will bond and provide a firm connection between base 38 bottom and surfboard deck 32. If a mounting plate 83 is affixed with adhesive to the suitably prepared flat top of surfboard deck, the base is affixed by screws 39 going through mounting holes 15 which screw into barrel 84 protruding up from mounting base 83. In such embodiments, base 38 is detachable by unscrewing screws 39 and interchangeable with any other base. If surfboard 87 were used instead of a surfboard 7 with a domed deck, mounting plate 84 can be affixed to surfboard 87 with no modifications to the surfboard 87 needed. It should be noted that wherever surfboard 7 is noted herein it is understood that the normally domed surfboard deck 32 has been suitably modified to have a flat surface where the base or mounting plate 84 will affix to the surfboard.

Figure 2:
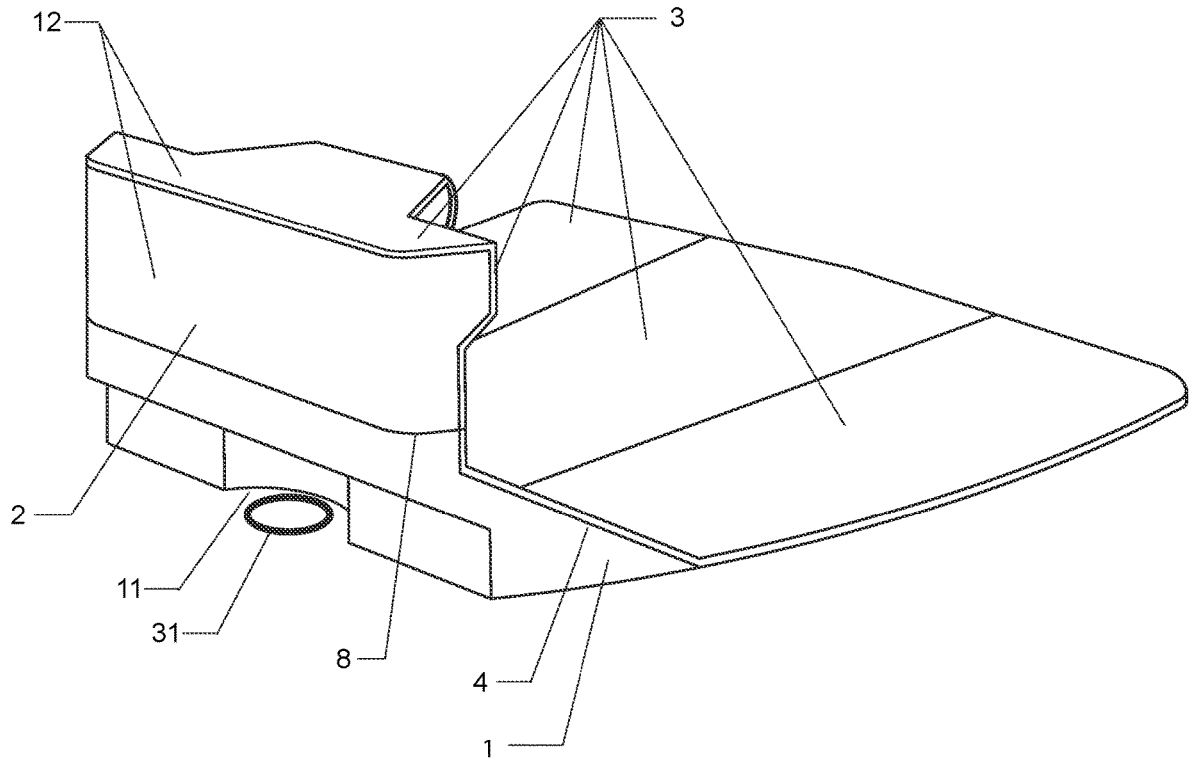
FIG. 2 is a rear perspective view of a 7 surfboard equipped with an enhanced surfboard traction pad with a one piece base 1 and a detachable top piece 2 featuring a horizontal overhang and a three piece traction pad.

Referring to FIG. 2, a perspective rear view of a surfboard 7 is shown equipped with an enhanced surfboard traction pad with a base 1 and a detachable top piece 2 featuring a horizontal overhang and a three piece traction pad. The top piece shown with a horizontal overhang may be removed and replaced with a top piece with a longer or shorter overhang, an angled overhang of any length 34, or a top piece with only a vertical face 59 of any height. This view shows the cut out for the surfboard leash pin hole 11 and the leash pin hole 31. This view shows how the base goes up and over the leash pin hole 11 allowing the surfer to plant the rear foot further back on the ramp area 4 and execute sharper turns. This view shows how large the top and rear of the enhanced surfboard traction pad will be and the space available 12 for branding with print and/or a logo.

Figure 3:
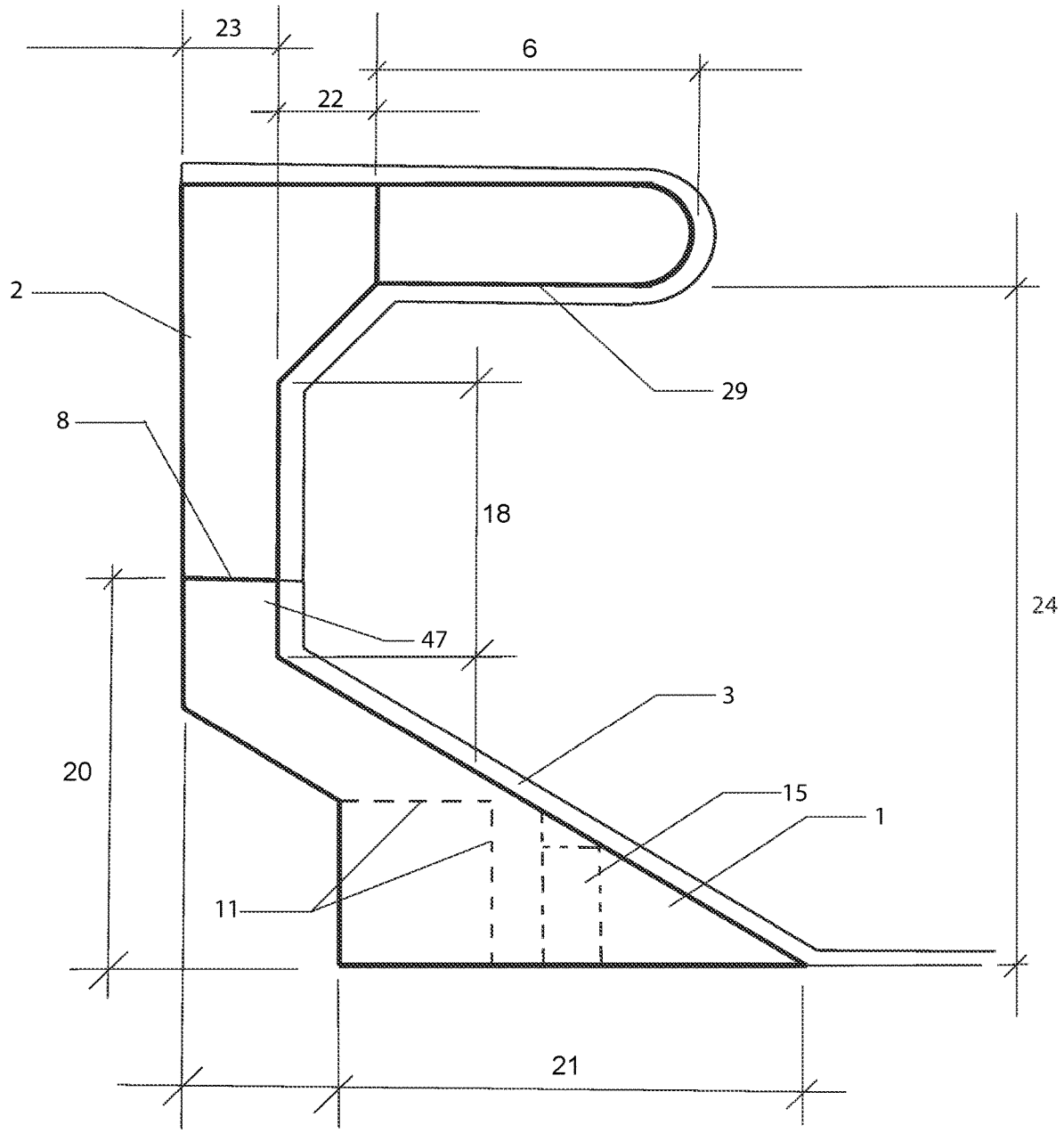
FIG. 3 is a side view of a 7 surfboard equipped with an enhanced surfboard traction pad with a one piece base 1 and a detachable top piece 2 featuring a horizontal overhang.

Referring to FIG. 3, a side view of a surfboard 7 is shown equipped with an enhanced surfboard traction pad with a base 1 and a detachable top piece 2 featuring a horizontal overhang. The top piece shown with a horizontal overhang may be removed and replaced with a top piece with a longer or shorter overhang, an angled overhang of any length 34, or a top piece with only a vertical face of any height 59. This view shows the hole for the mounting bolts 15.

Figure 4:
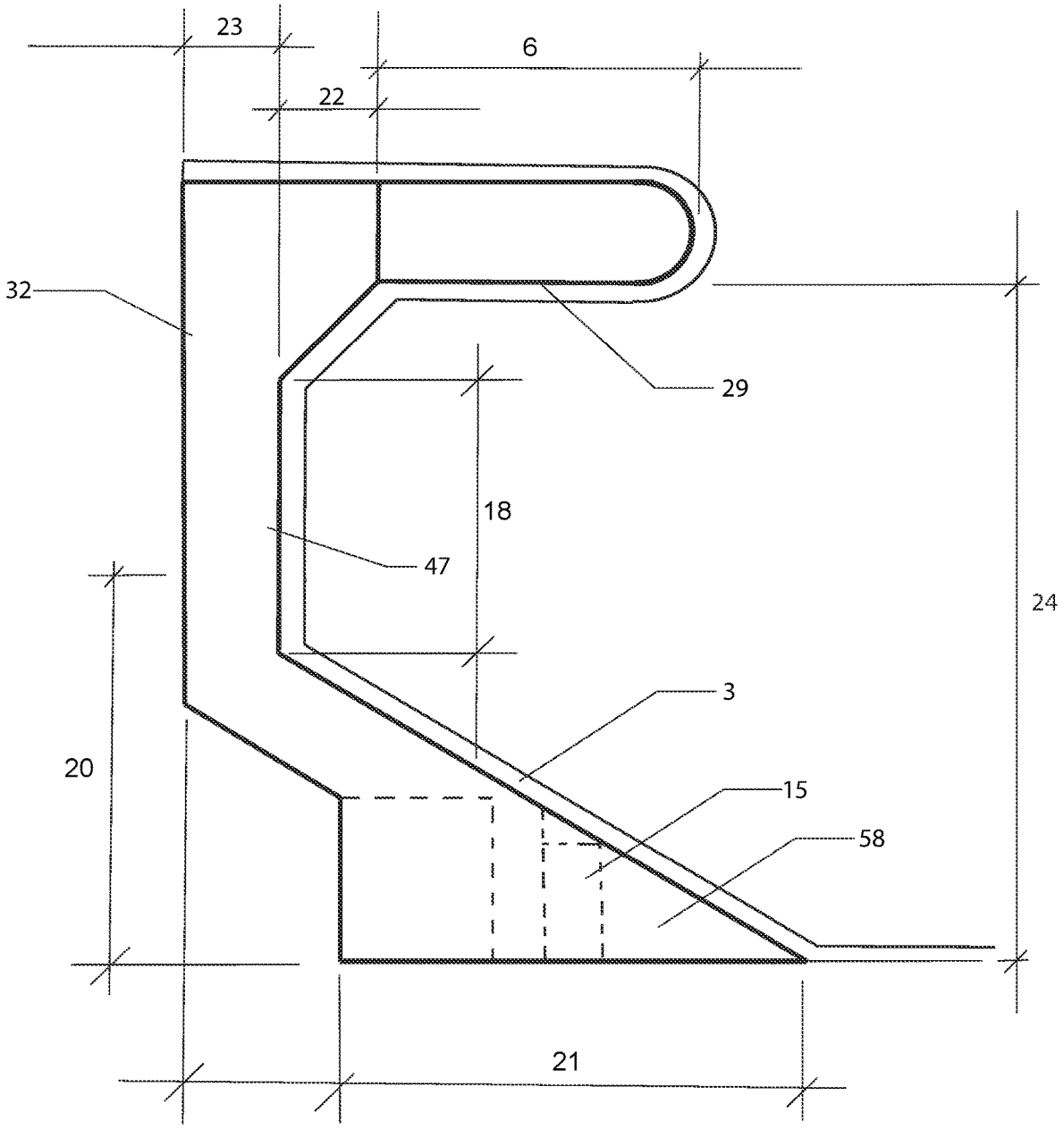
FIG. 4 is a side view of a 7 surfboard equipped with an enhanced surfboard traction pad with a single piece base 58 featuring a horizontal overhang.

Referring to FIG. 4, a side view of a surfboard 7 is shown equipped with an enhanced surfboard traction pad with a base 58 featuring a horizontal overhang. This base would be best suited for installation with a mounting plate 84 so it can be detached and a different base 30, 38, 77 installed since the top area of the base 58 with a horizontal overhang is not detachable or removable.

Figure 5:
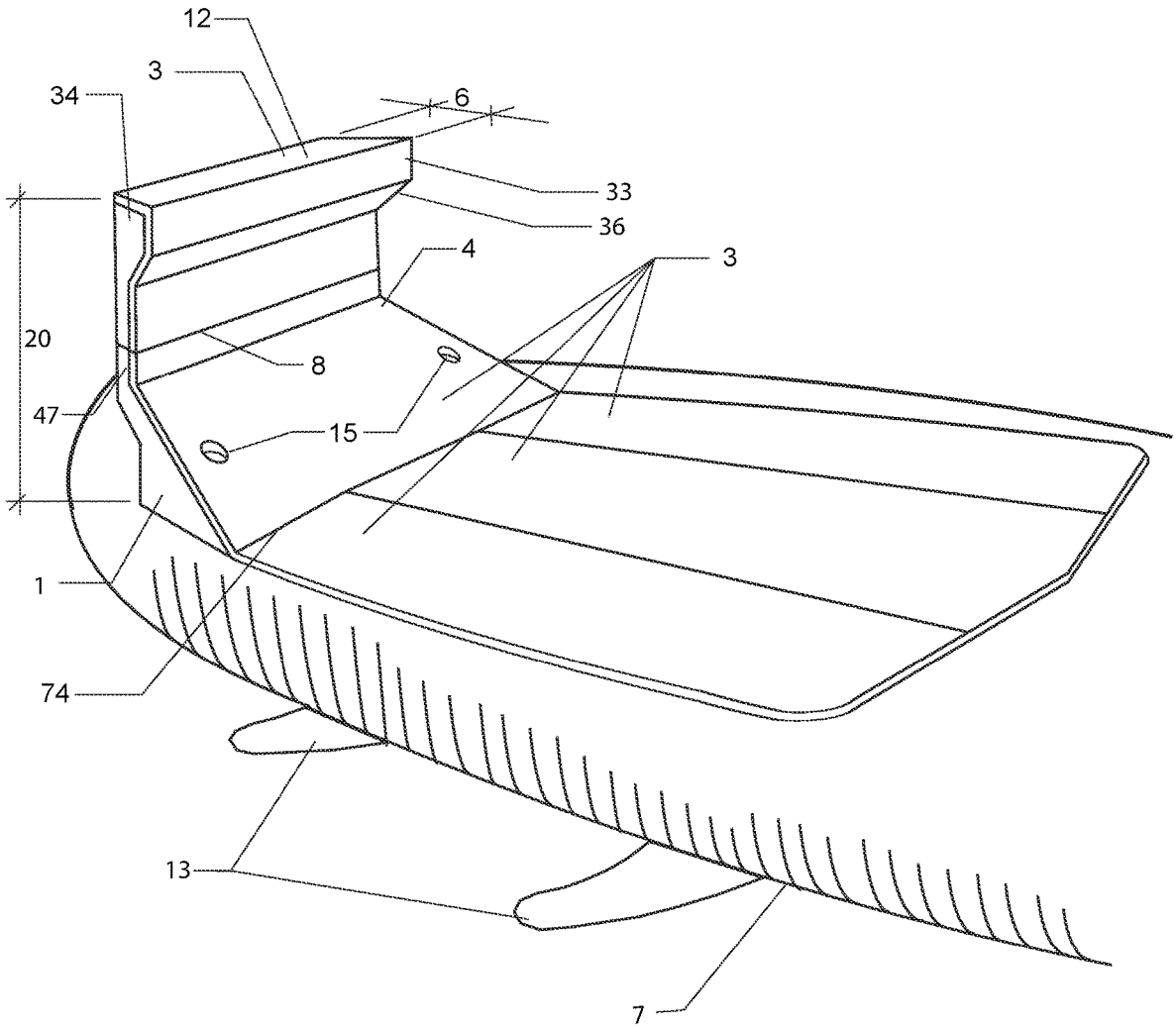
FIG. 5 is a perspective view of a 7 surfboard equipped with an enhanced surfboard traction pad with a one piece base 1 and a detachable top piece 34 featuring an angular overhang and a four piece traction pad.

Referring to FIG. 5, a perspective view of a 7 surfboard is shown equipped with an enhanced surfboard traction pad with a base 1 and a detachable top piece 34 featuring an angular overhang and a three piece traction pad. The angular overhang can extend forward to any length and in production models many lengths can be offered to give consumers a great deal of control over how the enhanced surfboard traction pad feels under their feet.

Figure 6:
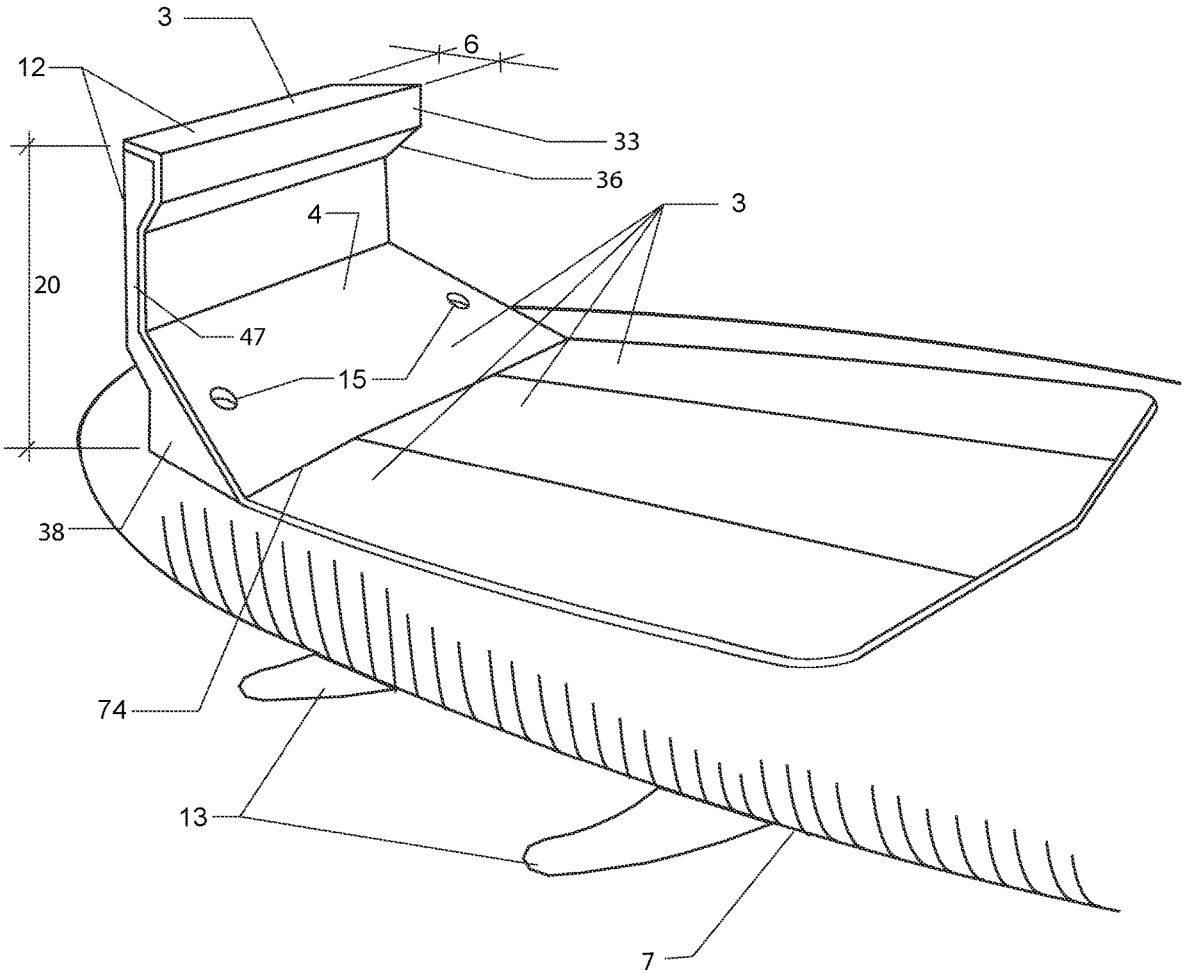
FIG. 6 is a perspective view of a surfboard 7 equipped with an enhanced surfboard traction pad with a single piece base 38 featuring an angular overhang and a three piece traction pad.

Referring to FIG. 6, a perspective view of a surfboard 7 is shown equipped with an enhanced surfboard traction pad with a one piece base 38 featuring an angled overhang and a three piece traction pad. This base would be best suited for installation with a mounting plate 84 so it can be detached and a different base 30, 58, 77 installed since the top area of the base 38 with an angled overhang is not detachable or removable. Traction pad material 3 is cut 74 at the foot of the ramp 4 so base 38 can be easily removed.

Figure 7:
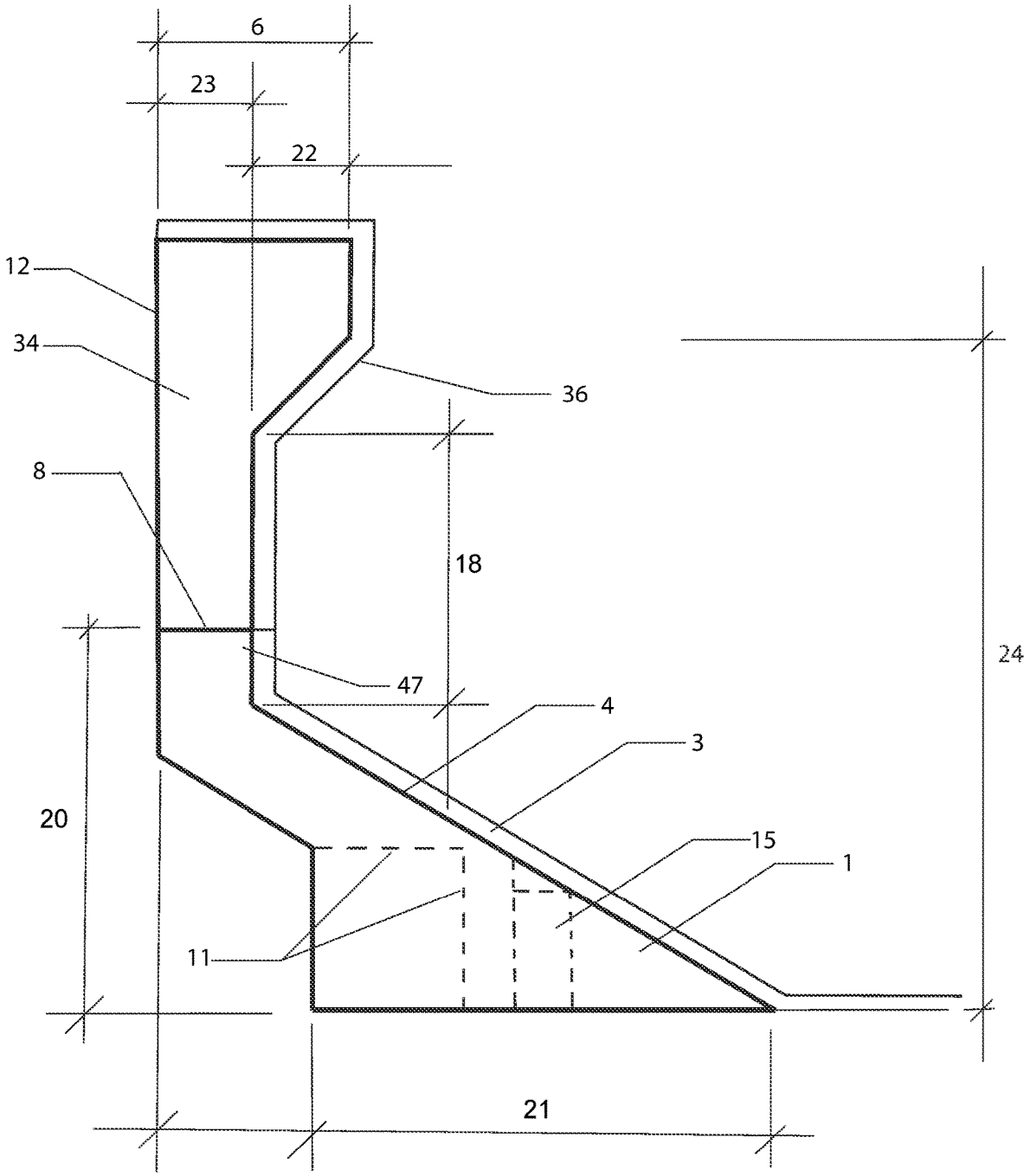
FIG. 7 is a side view of a surfboard 7 equipped with an enhanced surfboard traction pad with a detachable top piece 34 featuring an angular overhang.

Referring to FIG. 7, a side view of a surfboard 7 is shown equipped with an enhanced surfboard traction pad with a base 1 and detachable top piece 34 featuring an angular overhang. The angular overhang can extend forward to any length and in production models many lengths can be offered to give consumers a great deal of control over how much overhang is the perfect amount for their surfing style. In this view the mounting bolt holes 15 are shown. The contiguous flow of traction pad material 3 is shown coming from the top of the base 1, down the vertical face 47 of the base 1, down the ramp 4 and out to the front of the traction pad.

Figure 8:
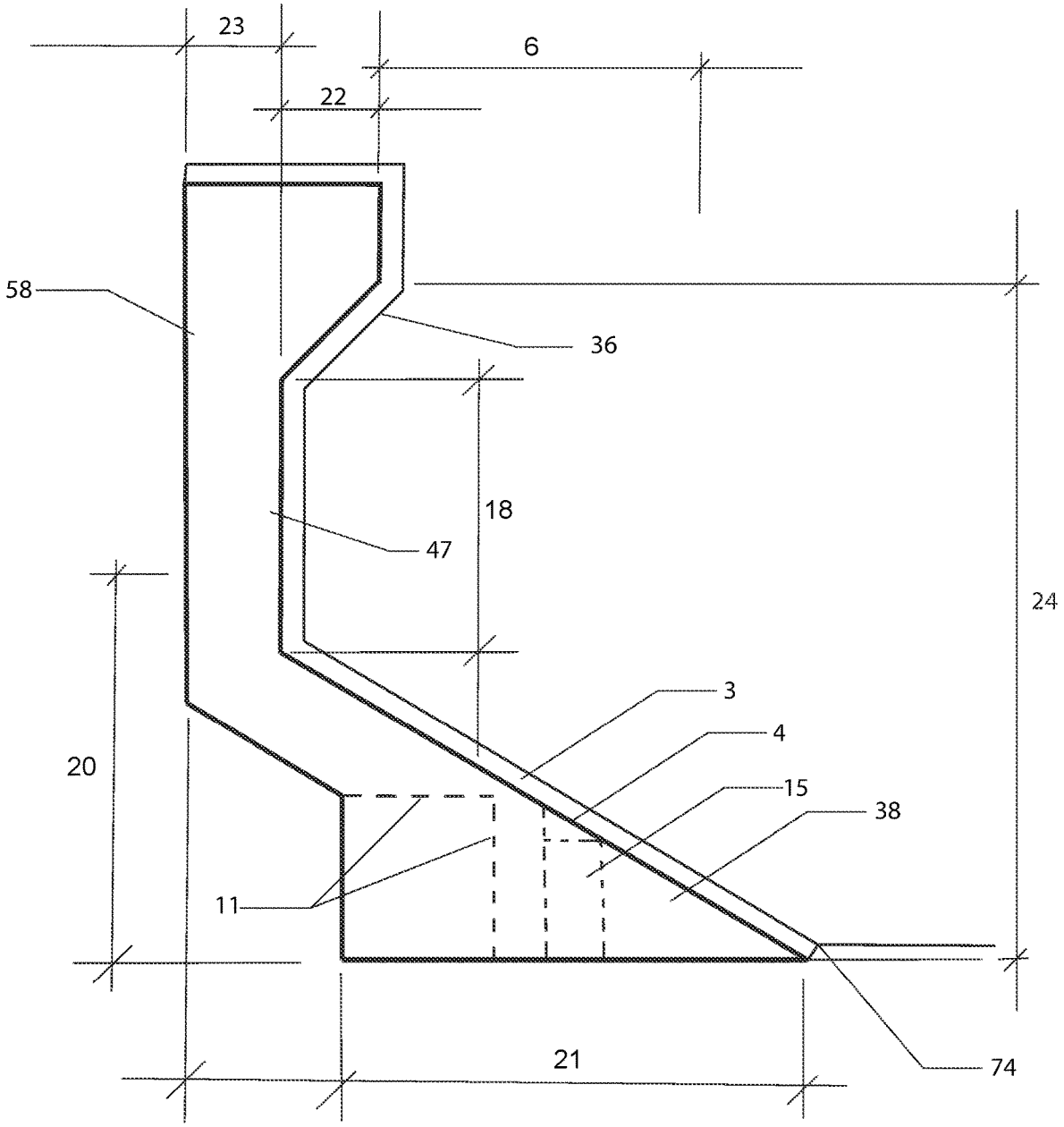
FIG. 8 is a side view of a surfboard 7 equipped with an enhanced surfboard traction pad with a single piece base 58 featuring an angular overhang.

Referring to FIG. 8, a side view of a surfboard 7 is shown equipped with an enhanced surfboard traction pad with a one piece base 38 featuring an angular overhang. In this view a possible location for mounting bolt holes 15 are shown. The contiguous flow of traction pad material 3 is shown coming from the top of the base 1, down the vertical face 47 of the base 1, down the ramp 4 and out to the front of the traction pad. This base would be best suited for installation with a mounting plate 84 so it can be detached and a different base 30, 58, 77 installed since the top area of the base 38 with an angled overhang is not detachable or removable. Traction pad material 3 is cut 74 at the foot of the ramp 4 so base 38 can be easily removed.

Figure 9:
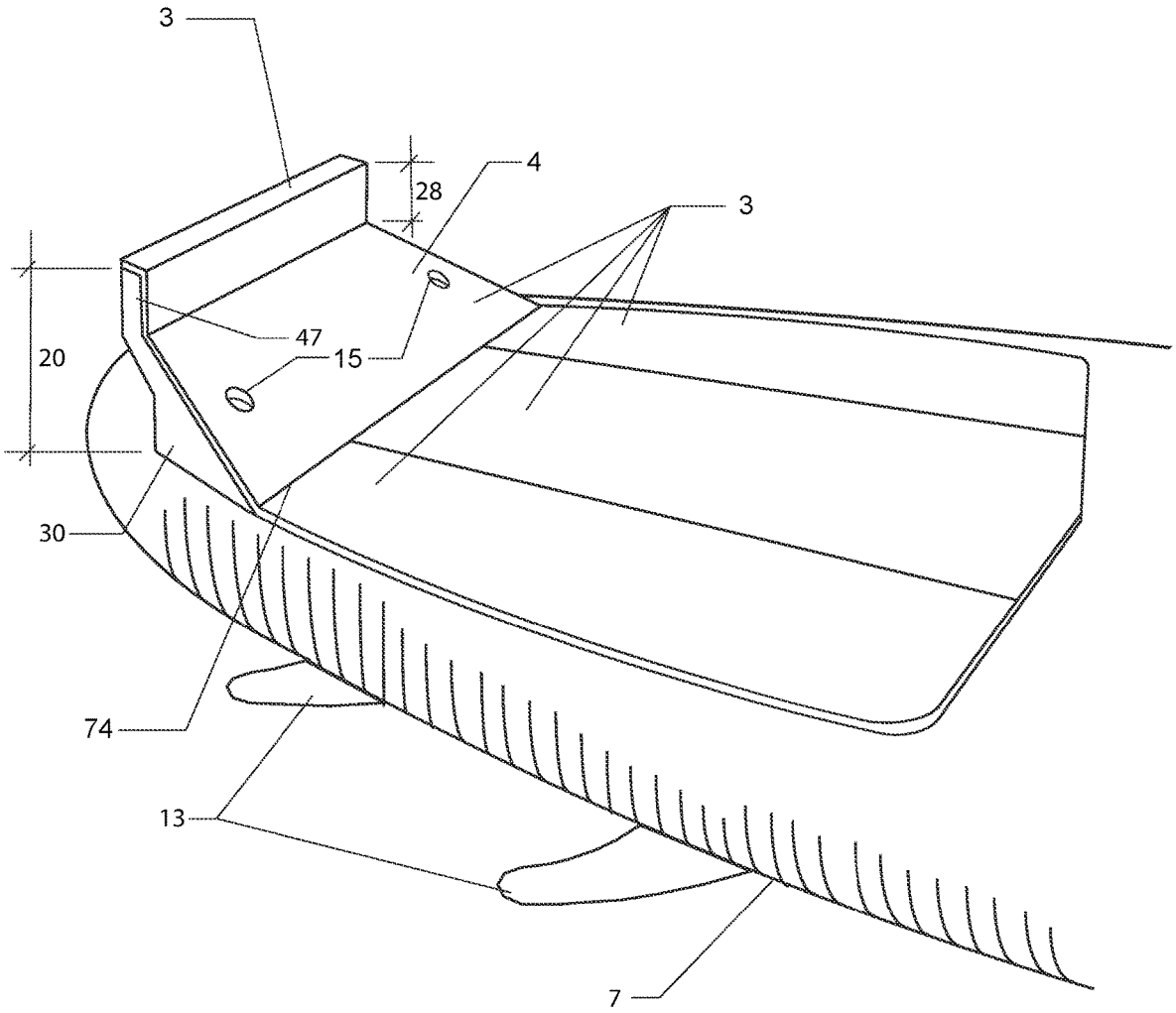
FIG. 9 is a perspective view of a surfboard 7 equipped with an enhanced surfboard traction pad with a single piece base 30 featuring a vertical back, no overhang, and a three piece traction pad.

Referring to FIG. 9, a front perspective view of a surfboard 7 is shown equipped with an enhanced surfboard traction pad with a one piece base 30 featuring a vertical face, no overhang, and a four piece traction pad. The ramp area 4 and vertical face shows how far back the surfer's rear foot can be placed. In this view a possible location for mounting bolt holes 15 is shown. This base would be best suited for installation with a mounting plate 84 so it can be detached and a different base 38, 58, 77 installed since the top area of the base 30 with a vertical rise is not detachable or removable. Traction pad material 3 is cut 74 at the foot of the ramp 4 so base 30 can be easily removed.

Figure 10:
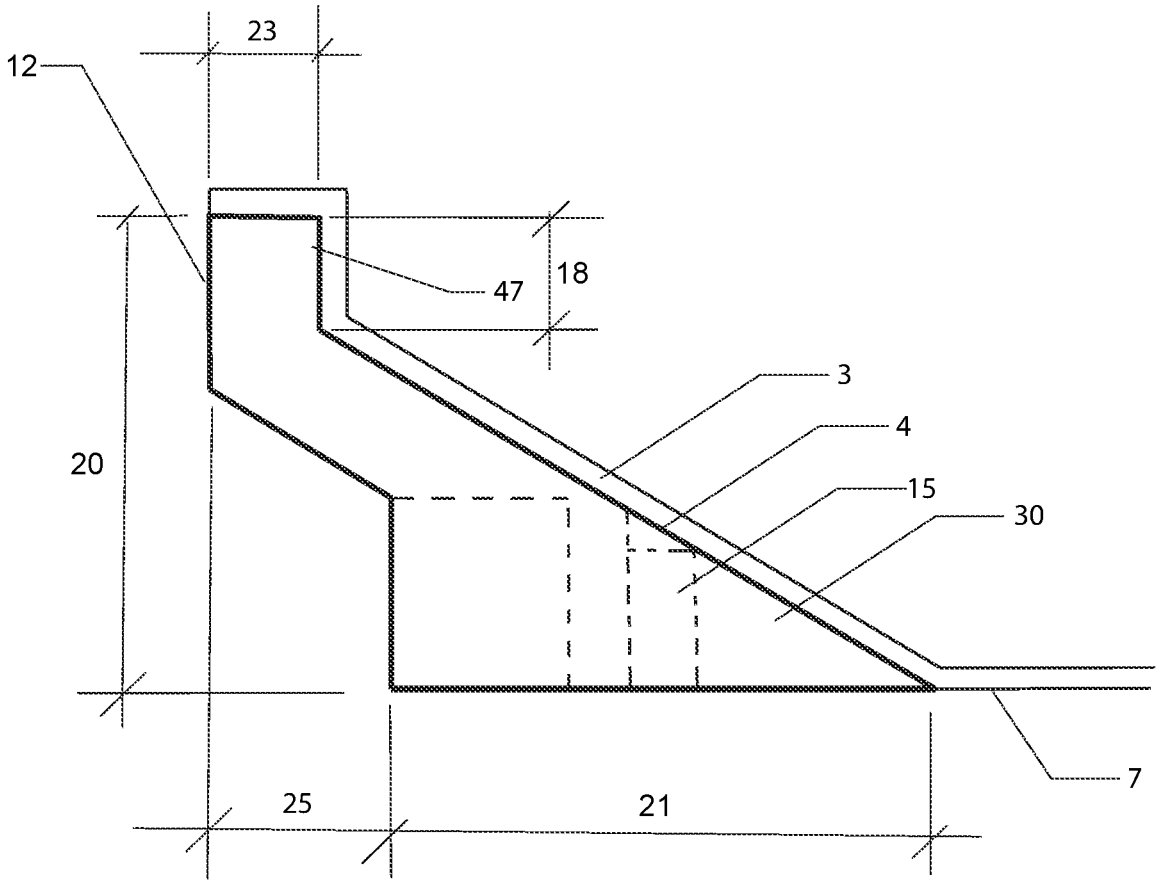
FIG. 10 is a side view of a surfboard 7 equipped with an enhanced surfboard traction pad with a one piece base 30 featuring a vertical back, no overhang, and a three piece traction pad.

Referring to FIG. 10, a side view of a surfboard 7 is shown equipped with an enhanced surfboard traction pad with a one piece base 30 featuring a vertical face and no overhang. In this view a possible location for mounting bolt holes 15 is shown. This base would be best suited for installation with a mounting plate 84 so it can be detached and a different base 38, 58, 77 installed since the top area of the base 30 with a vertical rise is not detachable or removable. Traction pad material 3 is cut 74 at the foot of the ramp 4 so base 30 can be easily removed.

Figure 11:
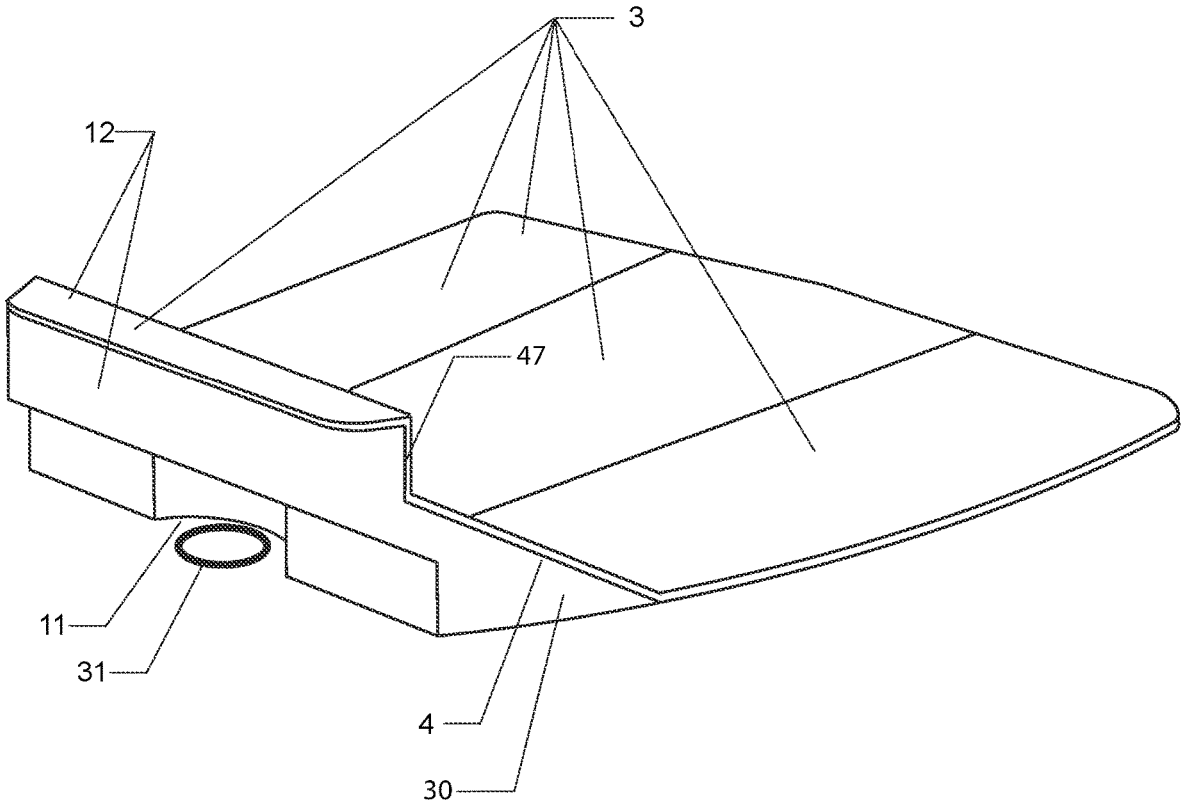
FIG. 11 is a perspective view of a surfboard 7 equipped with an enhanced surfboard traction pad with a one piece base 30 featuring a vertical back, no overhang, and a three piece traction pad.

Referring to FIG. 11, a rear perspective view of a surfboard 7 is shown equipped with an enhanced surfboard traction pad with a one piece base 30 featuring a vertical face, no overhang, and a four piece traction pad. This view shows how large the top and rear of the enhanced surfboard traction pad will be for this configuration and the space available 12 for branding with print and/or a logo.

Figure 12:
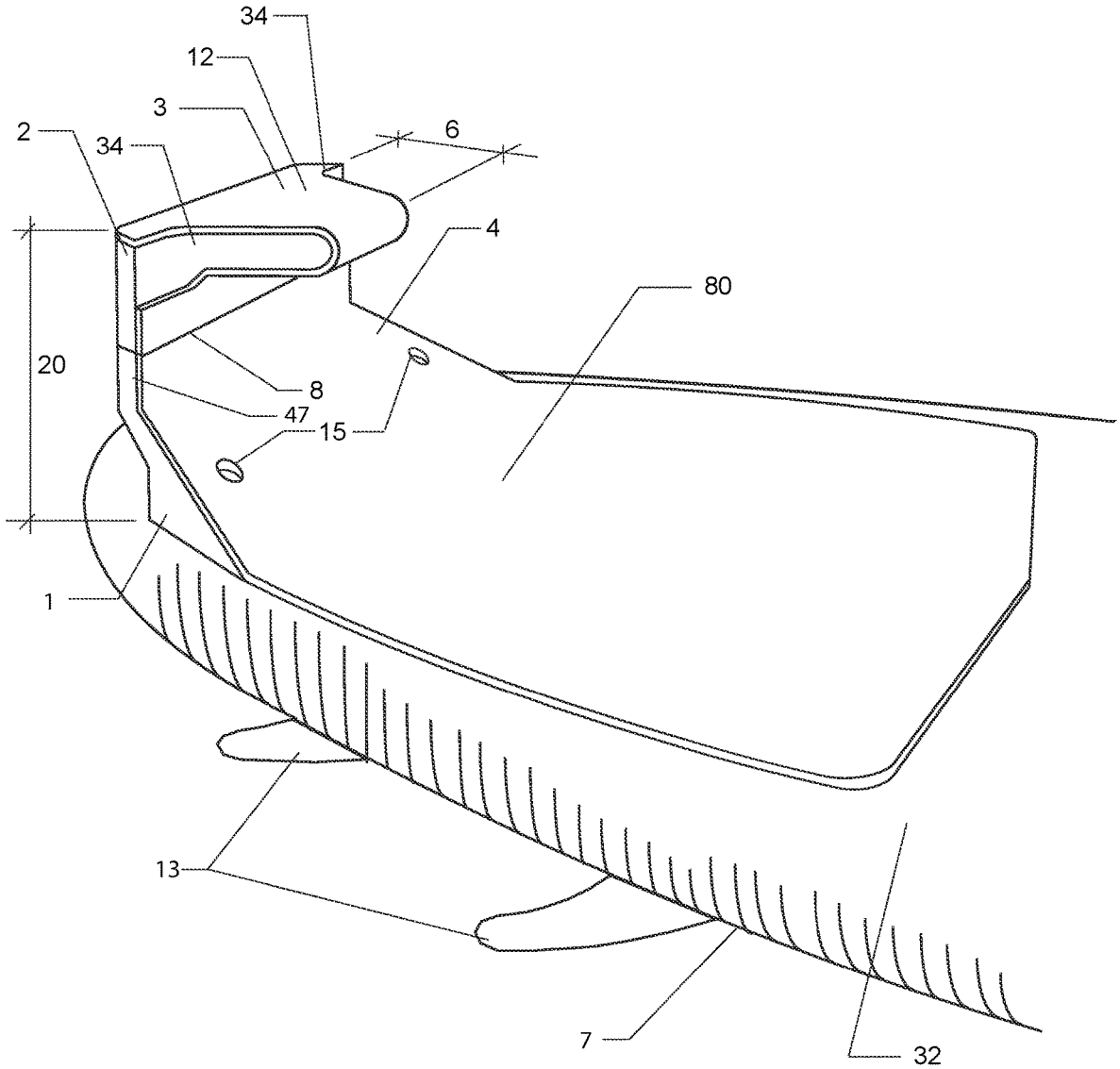
FIG. 12 is a perspective view of a 7 surfboard equipped with an enhanced surfboard traction pad with a one piece base 1 and a detachable top piece 2 featuring a horizontal overhang and a two piece traction pad (base 3 and top piece 3).

Referring to FIG. 12, a perspective front view of a surfboard 7 is shown equipped with an enhanced surfboard traction pad with a base 1 and a detachable top piece 2 featuring a horizontal overhang and a two piece traction pad, with the portion of the traction pad affixed to the base 1 and surfboard deck 32 being of one piece of traction pad material 80. The top piece shown with a horizontal overhang may be removed and replaced with a top piece with a longer or shorter overhang, an angular overhang of any length 34, or a top piece with only a vertical back of any height 59. The traction pad material 3 going up the ramp 4 from the surfboard deck 32 helps to secure the base.

Figure 13:
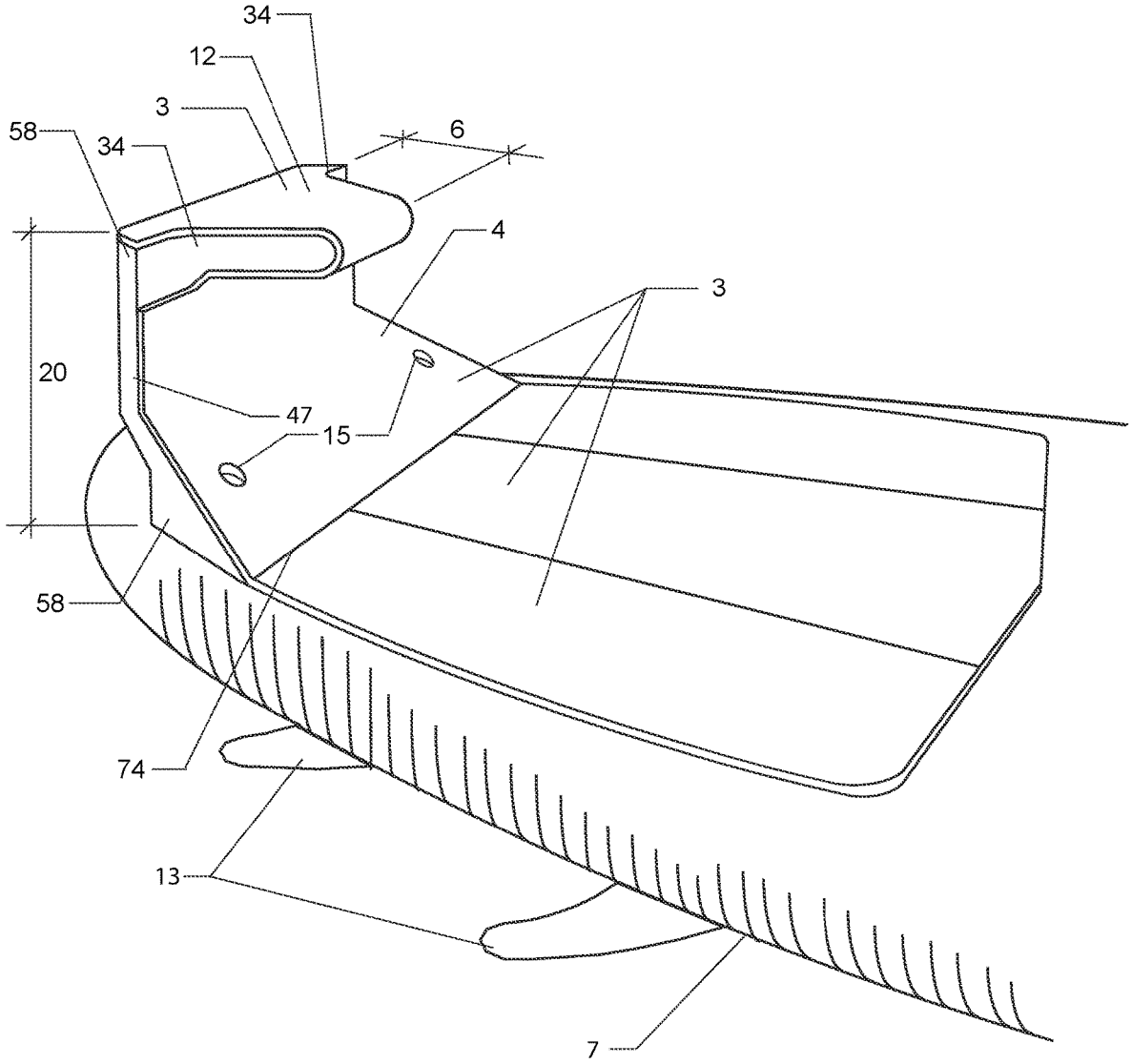
FIG. 13. is a perspective view of a 7 surfboard equipped with an enhanced surfboard traction pad with a one piece base 58 featuring a horizontal overhang and a two piece traction pad.

Referring to FIG. 13, a perspective view of a surfboard 7 is shown equipped with an enhanced surfboard traction pad with a one piece base 58 featuring a horizontal overhang and a four piece traction pad. This base would be best suited for installation with a mounting plate 84 so it can be detached and a different base 38, 30, 77 installed since the top area of the base 58 with a horizontal overhang is not detachable or removable. Traction pad material 3 is cut 74 at the foot of the ramp 4 so base 58 can be easily removed.

Figure 14:
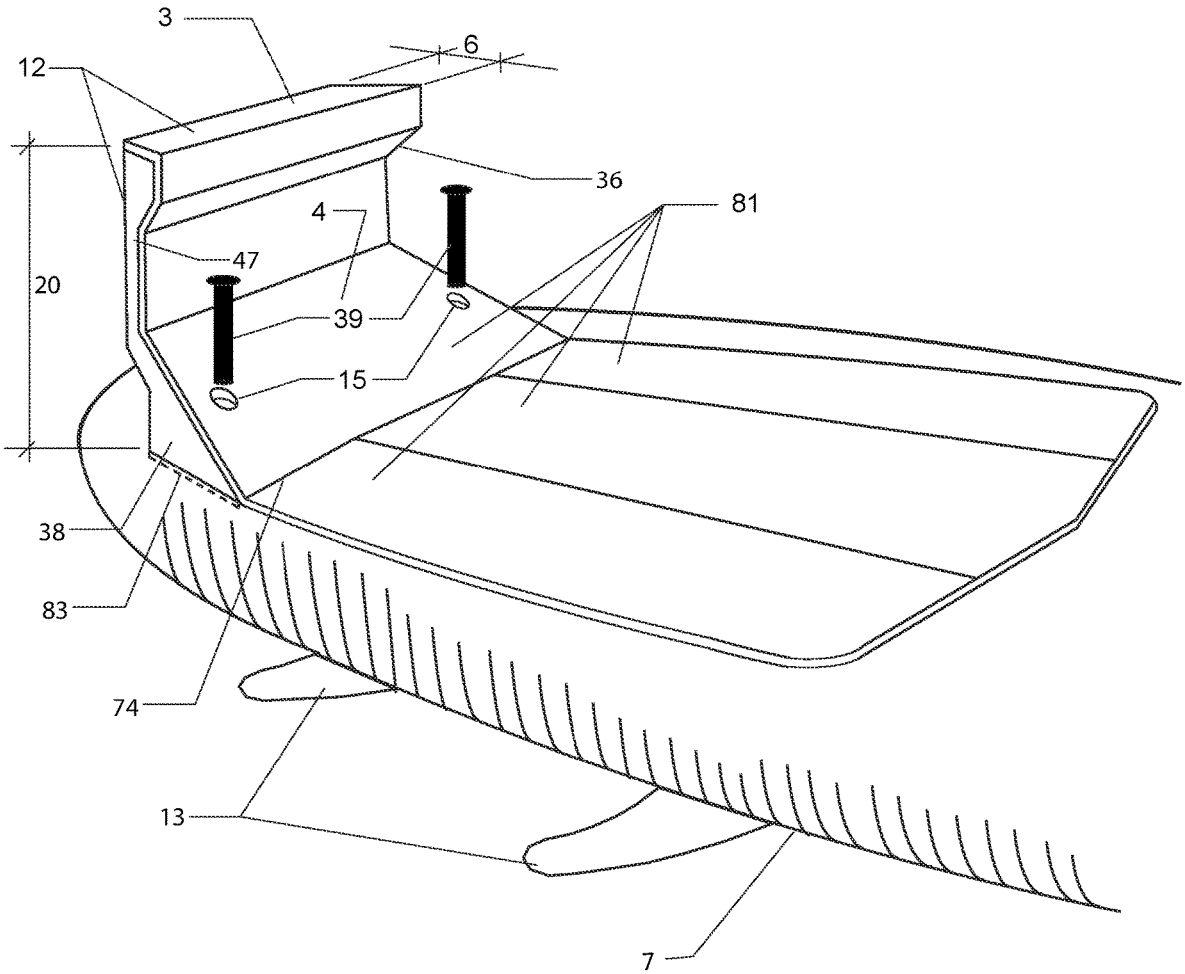
FIG. 14. is a perspective view of a 7 surfboard equipped with an enhanced surfboard traction pad with a one piece base 58 with an angled overhang, a three piece traction pad, and showing the bolts that mount the base to the surfboard.

Referring to FIG. 14, a perspective view of a 7 surfboard is shown equipped with an enhanced surfboard traction pad with a base 38 and a horizontal overhang, a four piece traction pad, and showing the screws 39 that mount the base to the mounting plate 83. Traction pad material 3 is cut 74 at the 5 foot of the ramp 4 so base 38 can be easily removed. In this embodiment the base 38 is detachable and interchangeable with other bases. Said mounting screws 39 can be made of any material but preferably such that is highly resistant to salt water exposure. Another option to securing said traction pad to the surfboard 7 is to use a permanent glue or adhesive between the bottom of the base and the deck of the surfboard. If the adhesive/glue used to affix the base 38 to the surfboard deck is of sufficient strength, a mounting plate and mounting screws will not be necessary, however if the base is permanently affixed to the surfboard deck said base will not be detachable or interchangeable with other bases.

Figure 15:
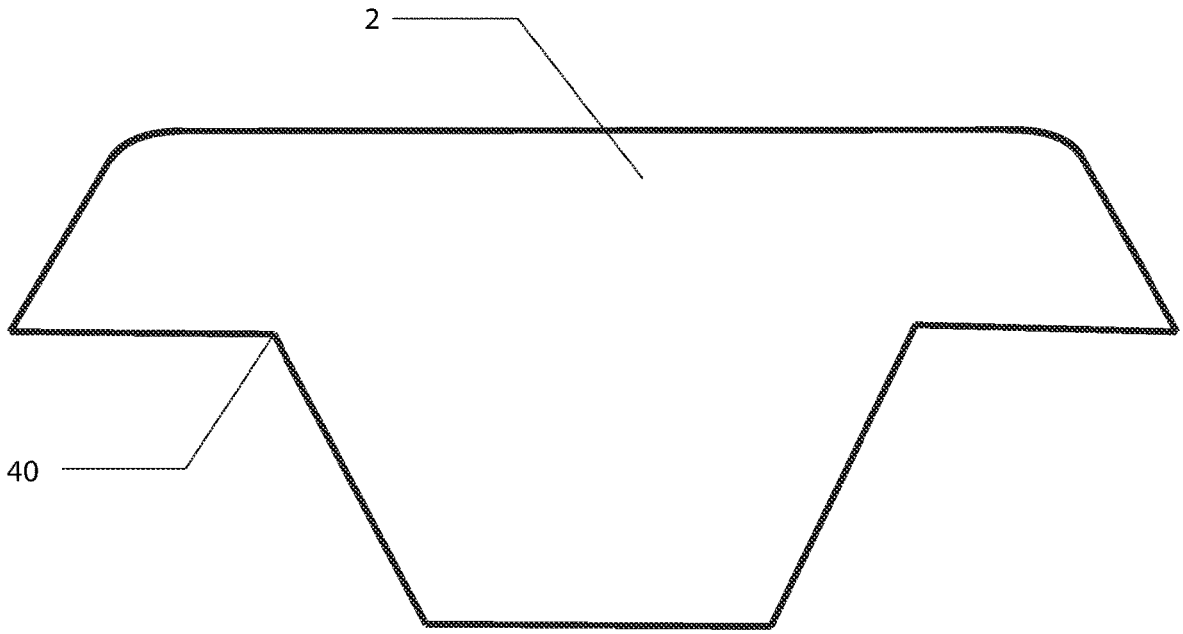
FIG. 15. is a top view showing different options for ankle cut outs.
Figure 15:
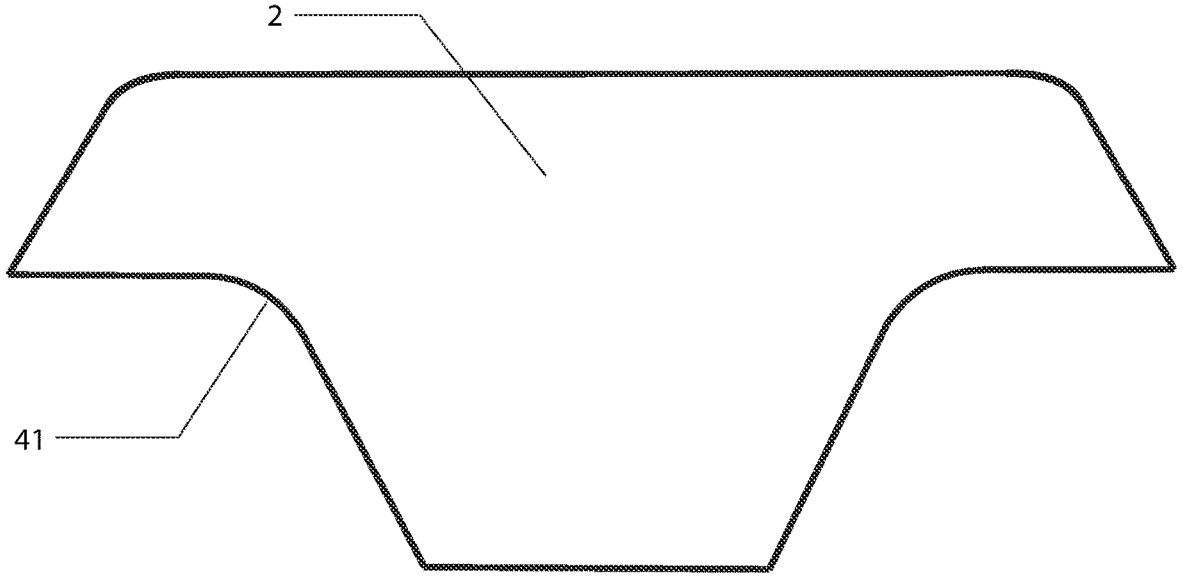

Referring to FIG. 15, a top view of a an enhanced surfboard traction pad is shown with two different types of ankle cut outs. Any combination of angles or curves can be used for said cut out. These are just a few of the many ways this can be accomplished.

Figure 16:
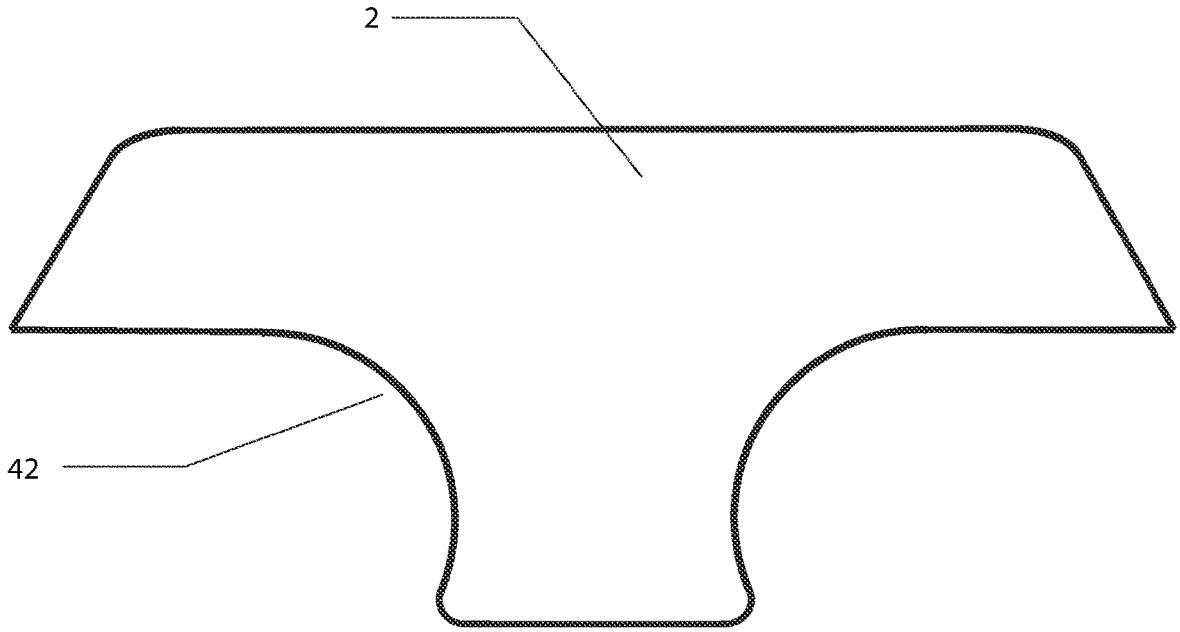
FIG. 16. is a top view showing different options for ankle cut outs.
Figure 16:
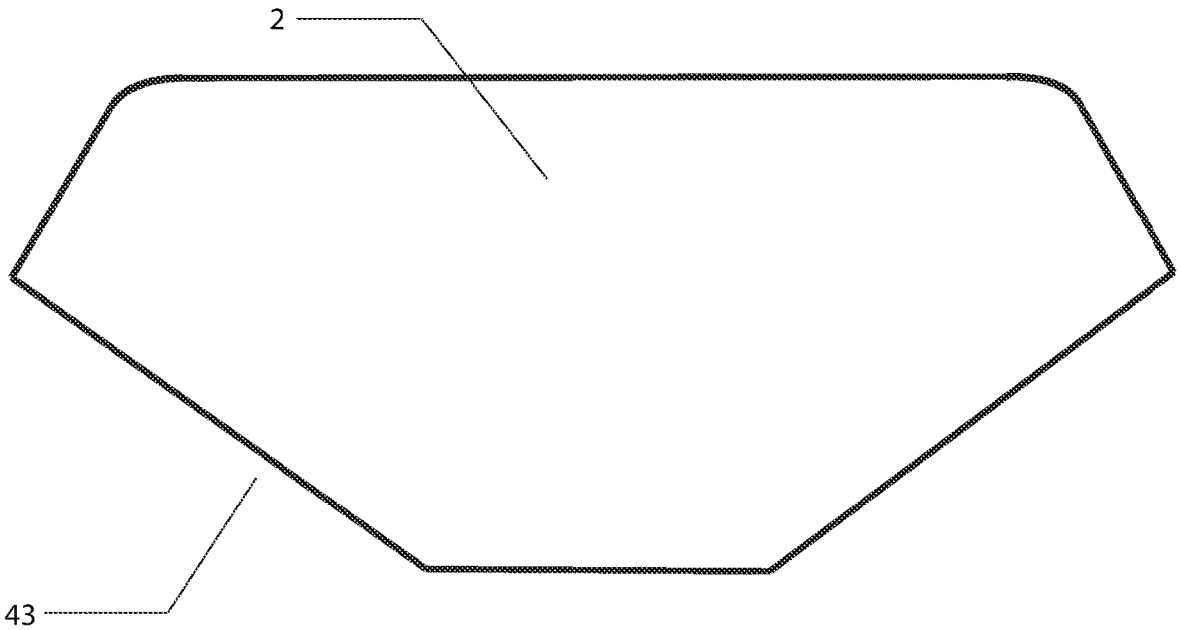

Referring to FIG. 16, a top view of a an enhanced surfboard traction pad is shown with another two different types of ankle cut outs. Any combination of angles or curves can be used for said cut out. These are just a few of the many ways this can be accomplished.

Figure 17:
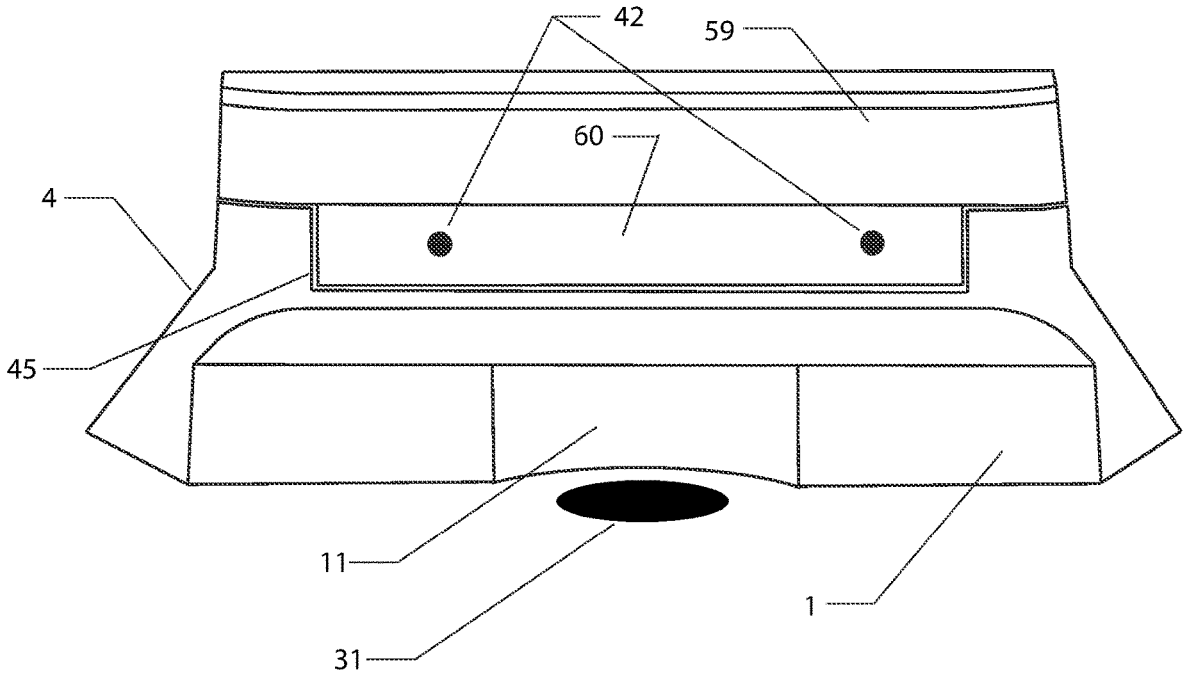
FIG. 17. is a rear view showing the top piece tongue and groove with an angled screw for attaching base 1 to vertical top piece 59.

Referring to FIG. 17, a perspective view of an enhanced surfboard traction pad with a base 1 and a detachable top piece 2 is shown partially cut away so the configuration of a method of securing the top piece 59 to the base 1 can be shown. The top piece has a bottom connecting tongue 60 which fits snugly into a groove 45 in the top of the base 1.

Figure 18:
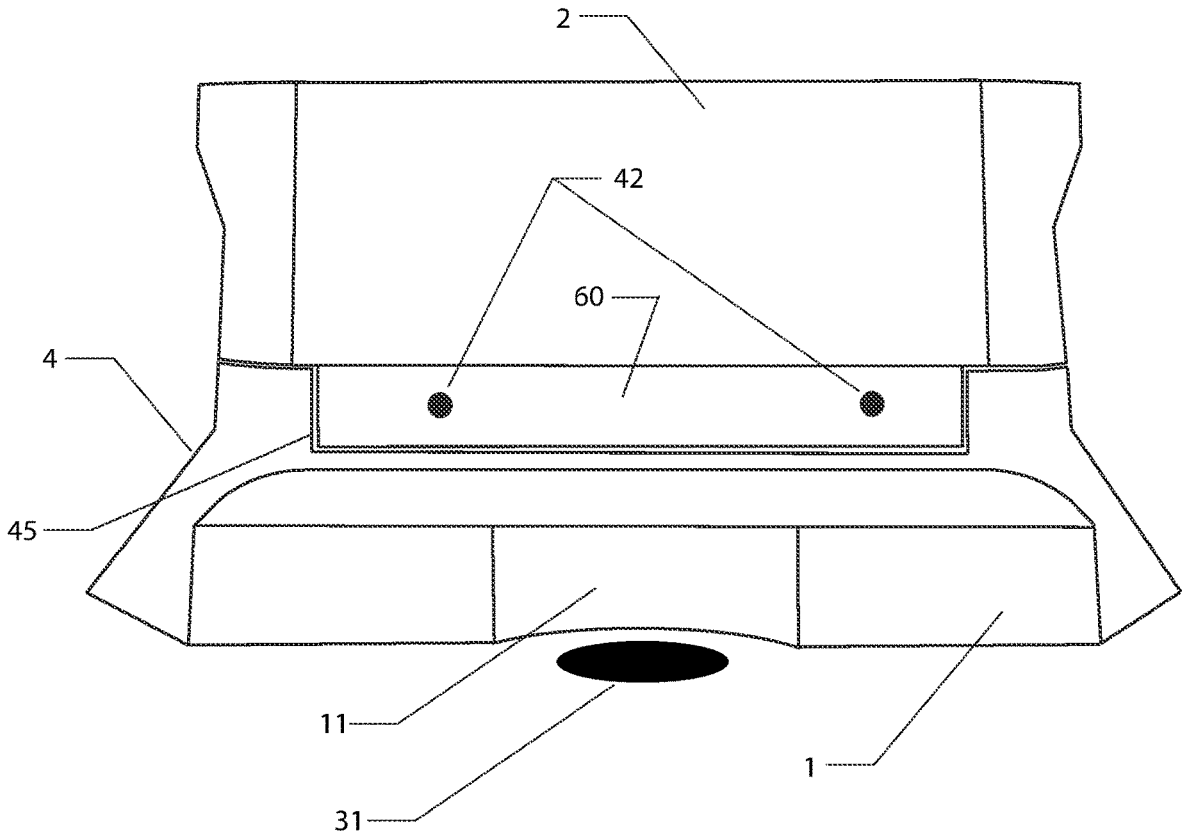
FIG. 18. is a rear view showing the top piece tongue and groove with screws for attaching base 1 to top piece 2 on the back.

Referring to FIG. 18, a perspective view of an enhanced surfboard traction pad with a base 1 and a detachable top piece 2 is shown partially cut away so the configuration of a method of securing the top piece 2 to the base 1 can be shown. The top piece has a bottom connecting tongue 60 which fits snugly into a groove 45 in the top of the base 1.

Figure 19:
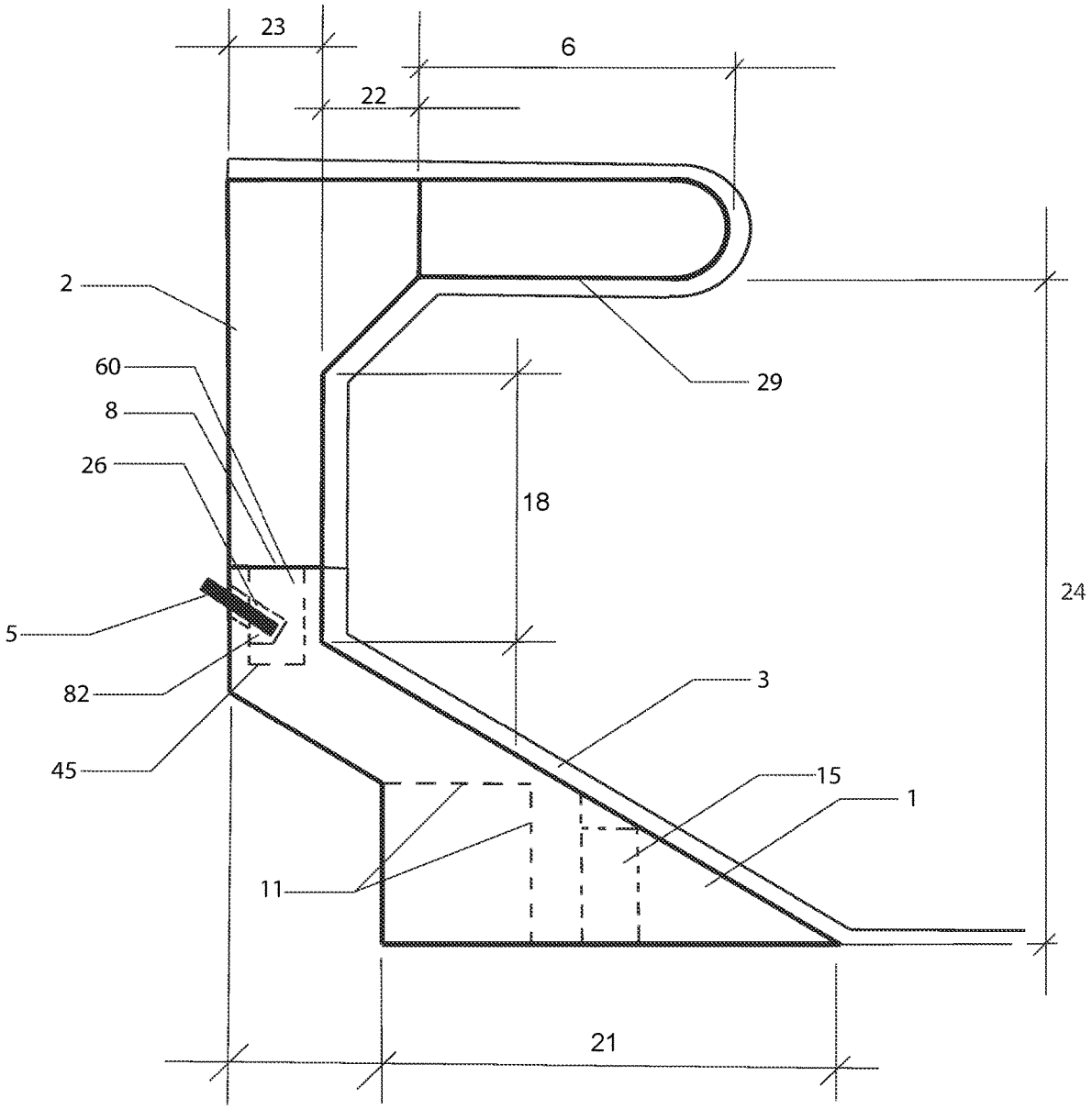
FIG. 19 is a side view of a traction pad base and angled screw for attaching said base to top piece.

Referring to FIG. 19, a side view of an enhanced surfboard traction pad with a base 1 and a detachable top piece 2 is shown so the configuration of a method of securing the top piece to the base can be shown in more detail. The top piece has a bottom tongue 60 which fits snugly into a groove 45 in the top of the base 1. In the base 1 groove 45 on the rear end are two angled holes for lining up with notches 82 in the top piece 2 through which screws 5 will be used for securing said top piece 2 to the base 1. For a snug and precise fit said groove 45 and tongue 60 may need to be machined. There are many ways known in the manufacturing trades for securing a tongue and groove to prevent the tongue from slipping out of the groove. The methods presented herein may be used or other suitable methods known to the manufacturing trades may be used with the end result of securing the tongue 60 on the top piece 2 to the groove in the base 1.

Figure 20:
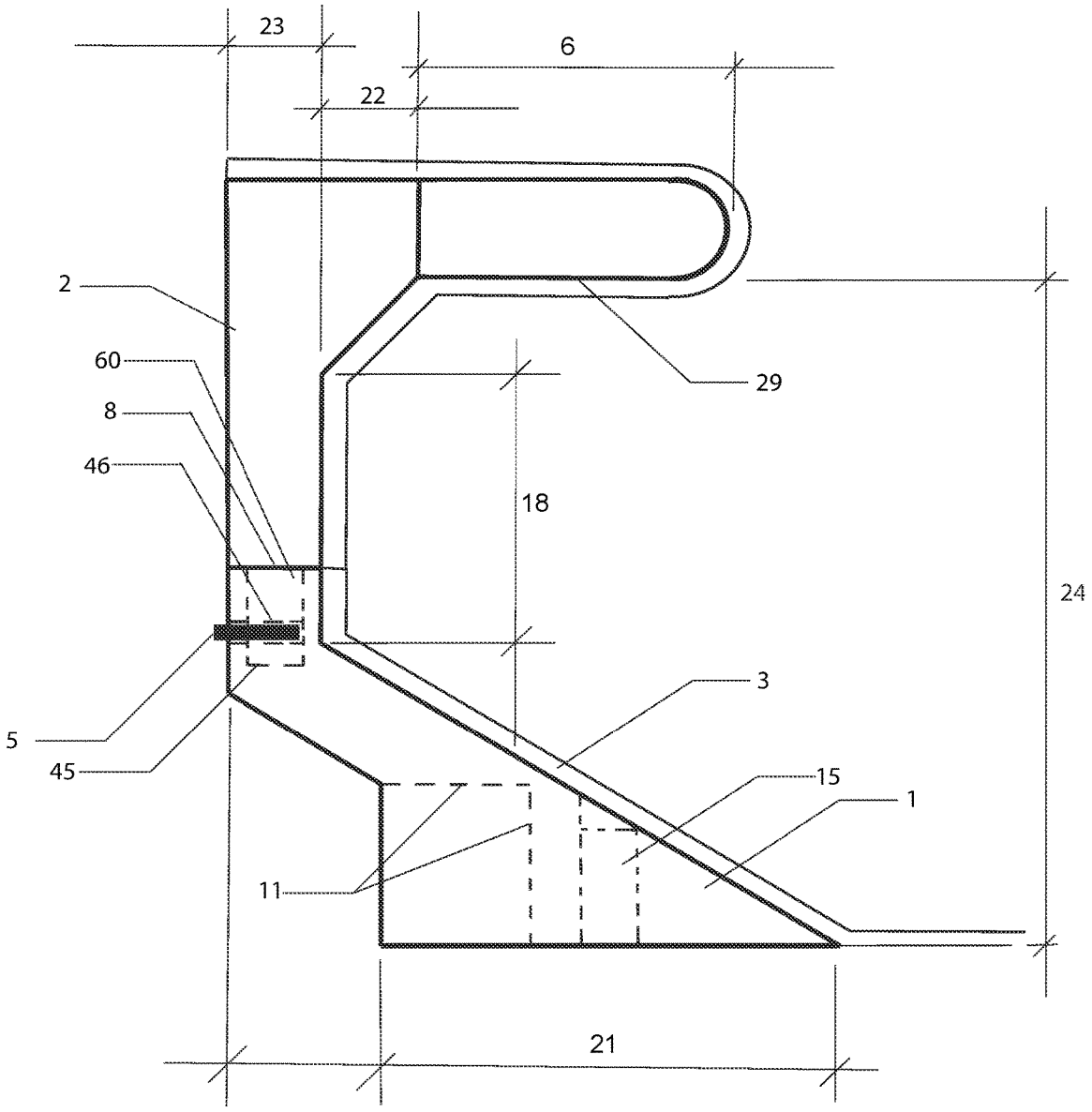
FIG. 20 is a side view of a traction pad base and horizontal rear screws for attaching said base to top piece.

Referring to FIG. 20, a side view of an enhanced surfboard traction pad with a base 1 and a detachable top piece 2 is shown so the configuration of a method of securing the top piece to the base can be shown. The top piece has a bottom tongue 60 which fits snugly into a groove 45 in the top of the base 1. In the base 1 groove 45 on the rear end are two threaded horizontal holes 46 for lining up with horizontal holes in the top piece through which screws 5 will be used for securing said top piece 2 to the base 1. There are many ways known in the manufacturing trades for securing a tongue and groove to prevent the tongue from slipping out of the groove. The methods presented herein may be used or other suitable methods known to the manufacturing trades may be used with the end result of securing the tongue 60 on the top piece 2 to the groove 45 in the base 1.

Figure 21:
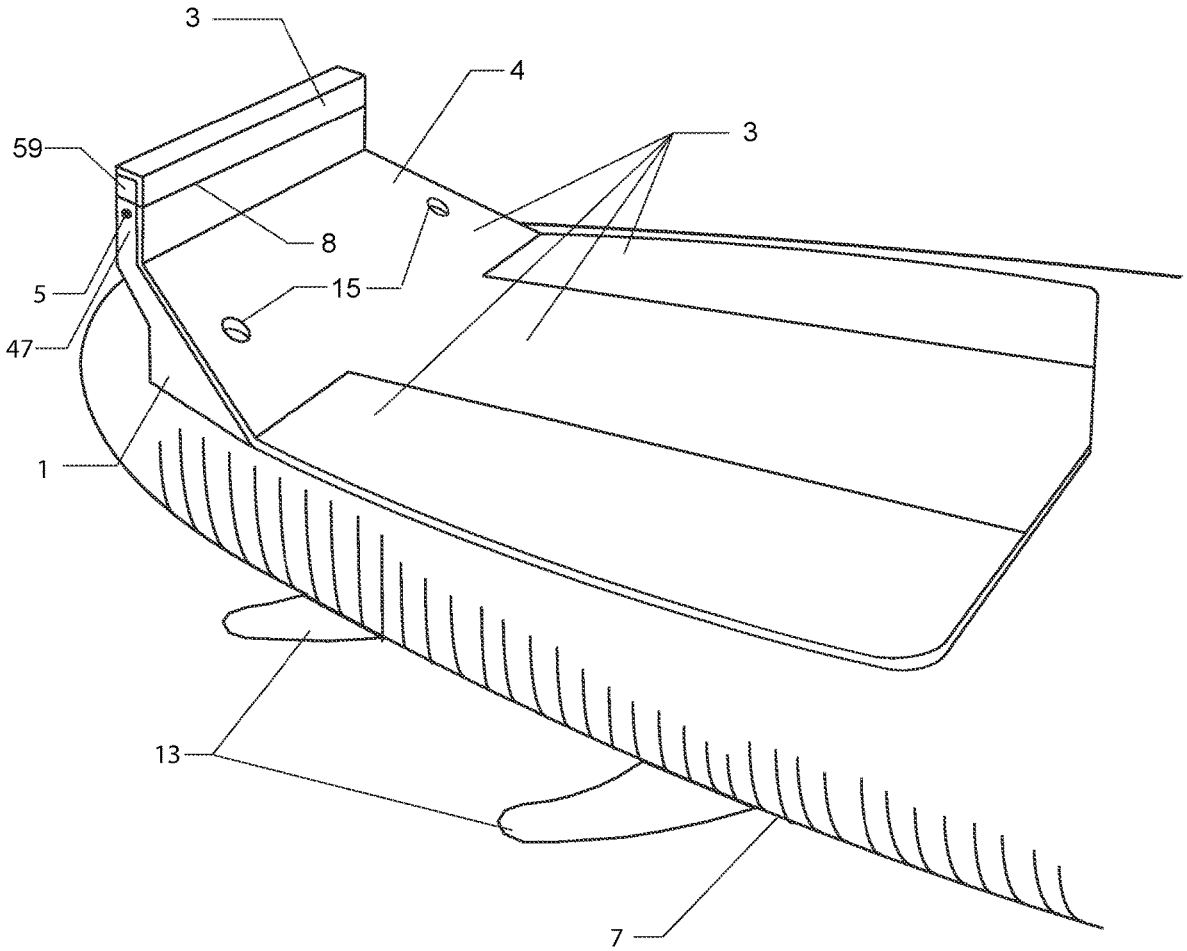
FIG. 21. is a perspective view of a 7 surfboard equipped with an enhanced surfboard traction pad with a one piece base 1 and a detachable top piece 59 cap.

Referring to FIG. 21, a perspective front view of a surfboard 7 is shown equipped with an enhanced surfboard traction pad with a base 1 and a detachable top piece 59 with a short vertical rise and a four piece traction pad. The top piece shown may be removed and replaced with a top piece with an angular overhang 34 of any length, a curved overhang 69, 70, 71, a horizontal overhang 2 or a top piece with only a vertical back 59 of any height. In this embodiment base 1 is permanently affixed to the surfboard deck so said base will not be detachable or interchangeable with other bases.

Figure 22:
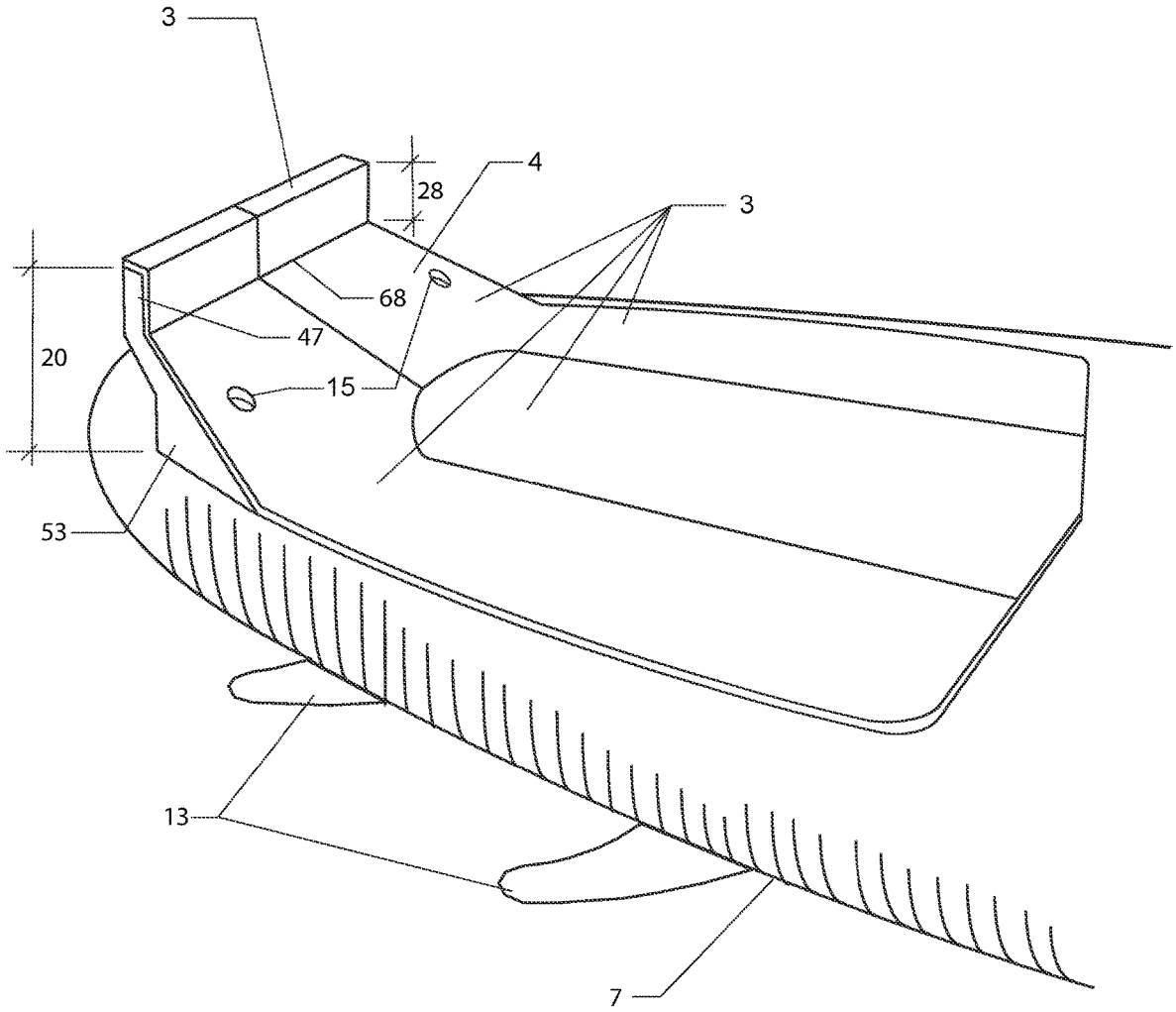
FIG. 22. is a perspective view of a 7 surfboard equipped with an enhanced surfboard traction pad with a two piece base 53, 54 with a vertical back.

Referring to FIG. 22, a perspective front view of a surfboard 7 is shown equipped with an enhanced surfboard traction pad with a two piece base 53, 54 with a vertical back and a three piece traction pad. The two piece base is preferably used when the enhanced surfboard traction pad is installed on a surfboard deck that does not have a flat surface where the enhanced surfboard traction pad is to be installed. Also, some surfers may prefer having a small gap between the left and right sides of the base which can be accomplished using the two piece base shown herein. Note that the left and right sides of the traction pad material 3 go from the deck of the surfboard up the ramp, up the vertical face of the left 53 and right 54 sides of the base and over the top in a contiguous manner which aid in securing base to surfboard deck. In this embodiment base 53, 54 is permanently affixed to the surfboard deck so said base will not be detachable or interchangeable with other bases. This left and right base configuration is best used when mounting the enhanced surfboard traction pad to a regular surfboard 7 that hasn't been prepared with a flat surface under the base.

Figure 23:
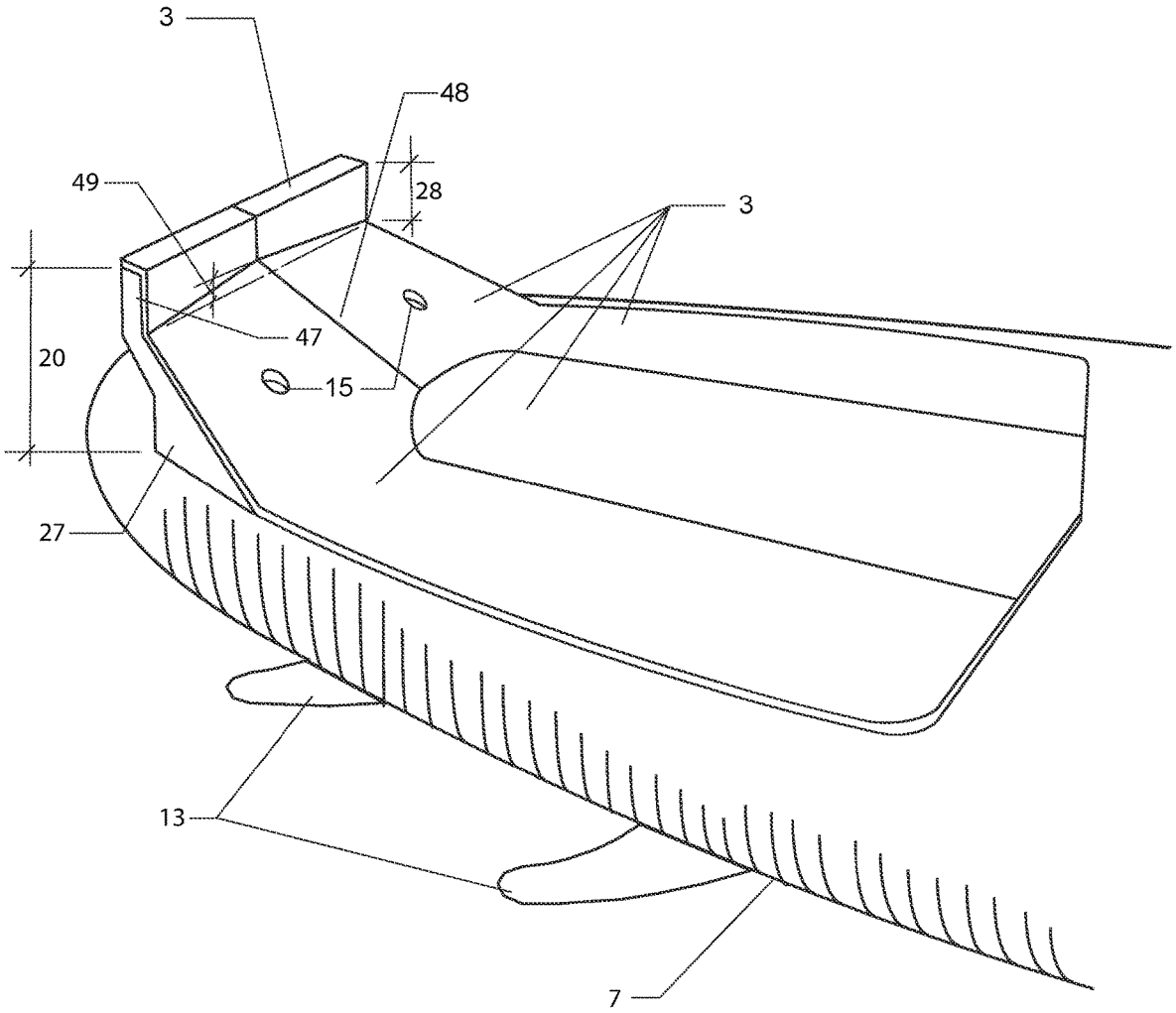
FIG. 23. is a perspective view of a 7 surfboard equipped with an enhanced surfboard traction pad with a two piece base 53, 54 with a vertical back and an arched ramp.

Referring to FIG. 23, a perspective front view of a surfboard 7 is shown equipped with an enhanced surfboard traction pad with a two piece base with a vertical face, a three piece traction pad and an arched ramp area 48. Some surfers like a slight arch under their feet which is shown in this embodiment of the enhanced surfboard traction pad. The rise at the center of the ramp 55 which creates said arch can be any amount. Said arch can be applied to any base 1, 27, 30, 38, 53, 54, 56, 57, 58, 62, 63. Note that the left and right sides of the traction pad material go from the deck of the surfboard up the ramp, up the vertical face of the left and right sides of the base and over the top in a contiguous manner.

Figure 24:
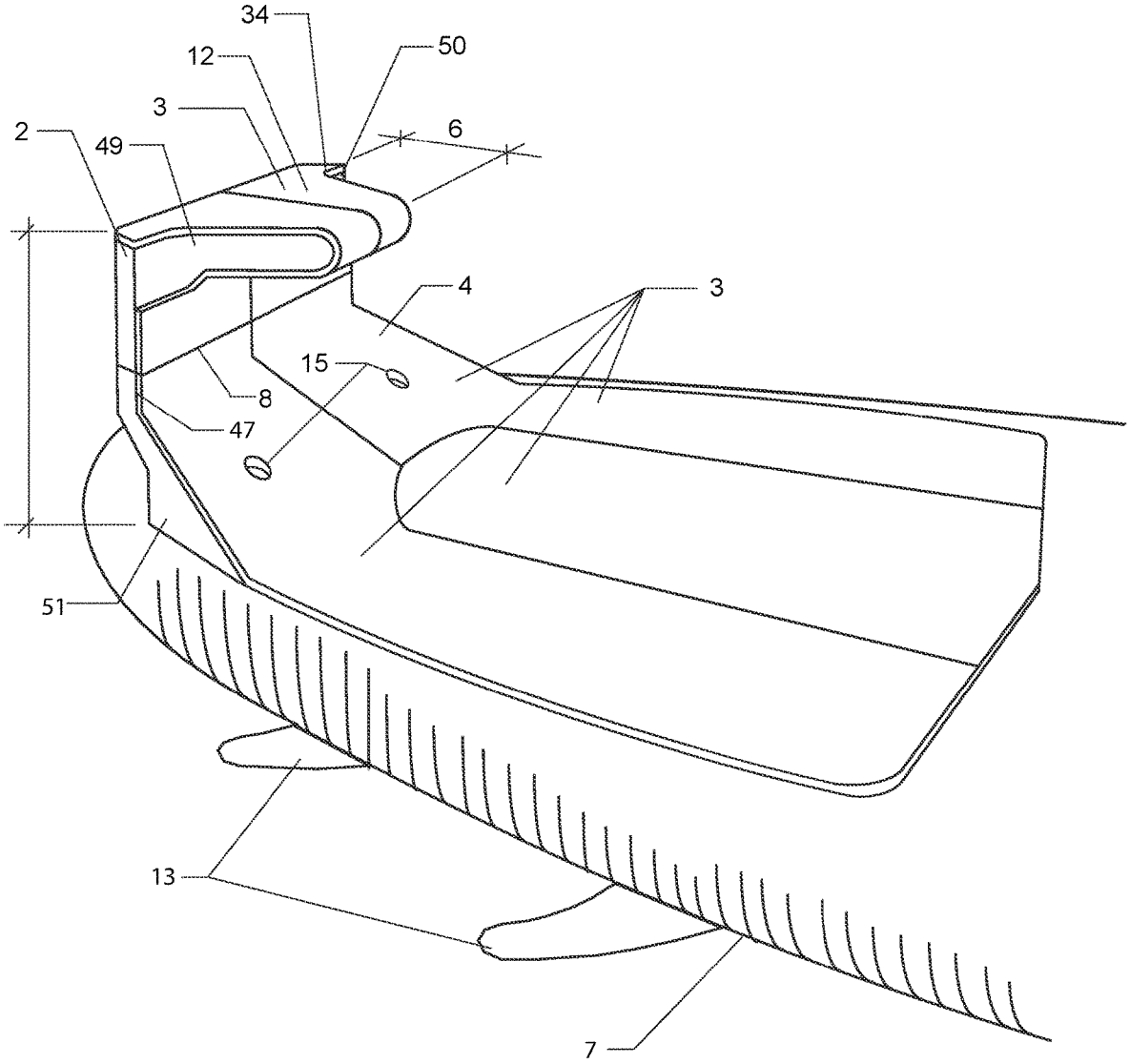
FIG. 24. is a perspective view of a 7 surfboard equipped with an enhanced surfboard traction pad with a two piece base 51, 52 with top pieces attached 49, 50 with a horizontal overhang.

Referring to FIG. 24, a perspective front left view of a surfboard 7 is shown equipped with an enhanced surfboard traction pad with a two piece base 51, 52 and detachable top pieces 49, 50 featuring a horizontal overhang and a five piece traction pad. The top piece shown with a horizontal overhang may be removed and replaced with a top piece with a longer or shorter overhang, an angular overhang of any length 64, 65, or a top piece with a vertical face 66, 67 of any height, or a top piece with a curved overhang 69, 70. Note that the left and right sides of the traction pad material go from the deck of the surfboard up the ramp, up the vertical face of the left 51 and right 52 sides of the base and up the vertical section of the base 47 in a contiguous manner.

Figure 25:
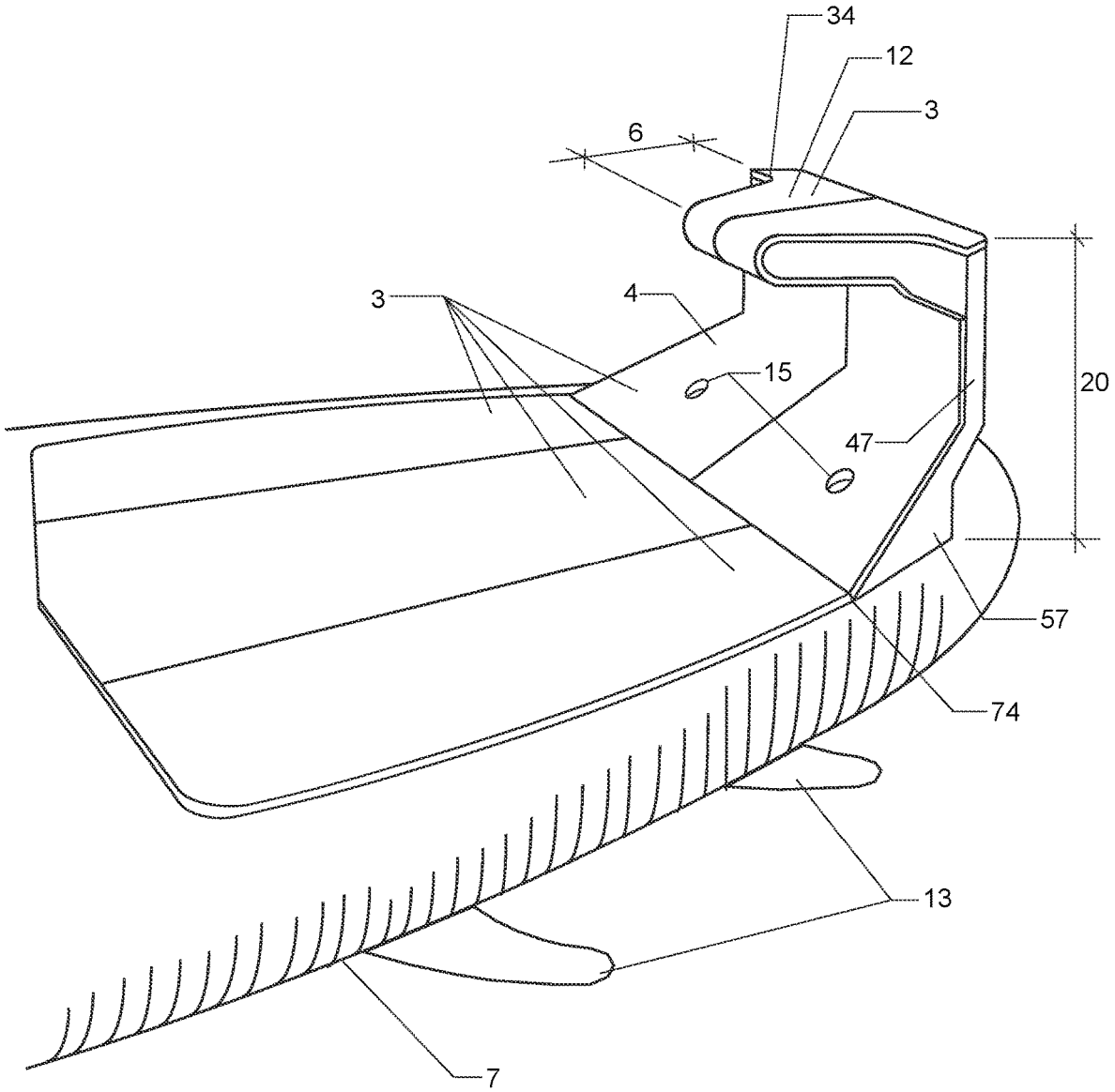
FIG. 25. is a perspective view of a surfboard 7 equipped with an enhanced surfboard traction pad with a one piece base 56, 57 and top pieces 49, 50 attached with a horizontal overhang.

Referring to FIG. 25, a perspective front right view of a surfboard 7 is shown equipped with an enhanced surfboard traction pad with a two piece base 56, 57, integrated with a horizontal overhang and a five piece traction pad. Traction pad material 3 is cut 74 at the foot of the ramp 4 so base 56, 57 can be easily removed.

Figure 26:
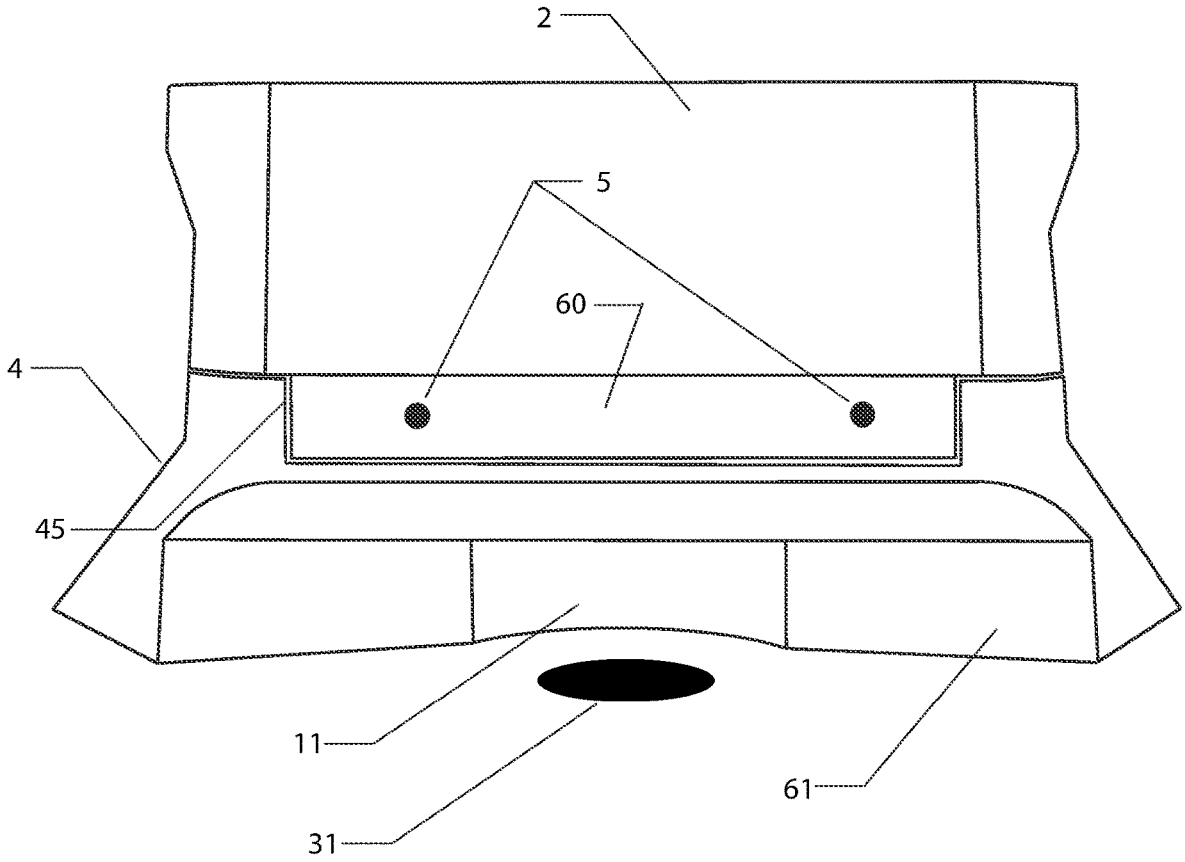
FIG. 26. is a perspective front left view of a surfboard 7 equipped with an enhanced surfboard traction pad with a two piece base 51, 52 and detachable top pieces 49, 50 featuring a horizontal overhang and a five piece traction pad.

Referring to FIG. 26, a perspective rear view of an enhanced surfboard traction pad is shown with base configured with an arched bottom 61. Most surfboards have an arched center that is higher than the edges. When mounting said traction pad, one mounting option is to create the base 61 of said traction pad with a slight arch on the bottom to match the arch in the surfboard so the adhesive that bonds said traction pad base 61 to the surfboard deck will have maximum surface area to adhere to. Another mounting option is to add extra layers of fiberglass to the deck of the surfboard under where said traction pad will be located, then sand down the extra layers of fiberglass to a flat surface to be used for mounting said traction pad manufactured with a flat bottomed base 1, 30, 38. The bottom of the base of said traction pad may be designed and manufactured to be flat, arched, and can be configured with any shape, size, angle, curvature or combination of angles that optimizes mounting to the deck of the surfboard.

Figure 27:
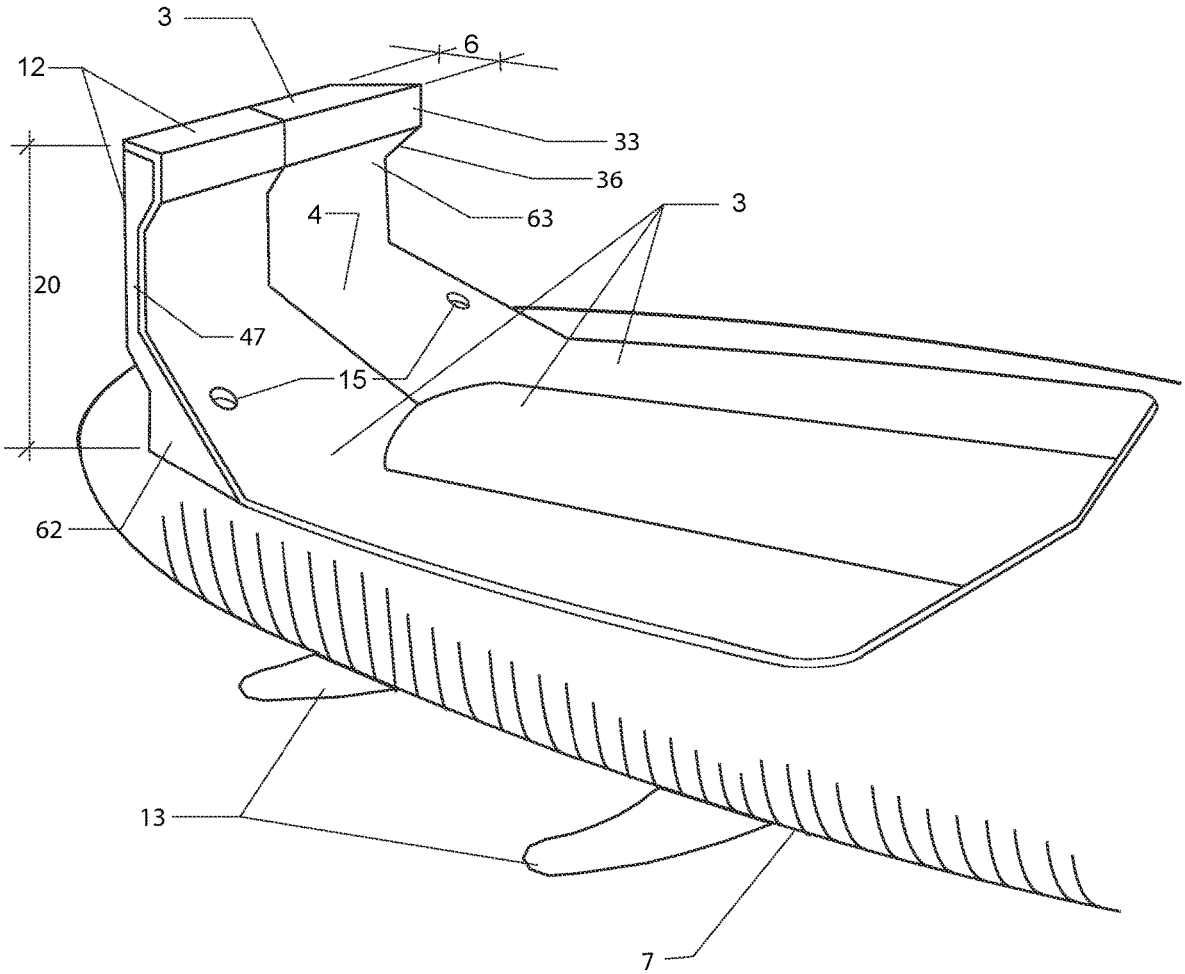
FIG. 27. is a perspective view of a surfboard 7 equipped with an enhanced surfboard traction pad with a two piece base 62, 63 featuring an angular overhang and a three piece traction pad.

Referring to FIG. 27, a perspective view of a surfboard 7 is shown equipped with an enhanced surfboard traction pad with a two piece base 62, 63 featuring an angular overhang and a three piece traction pad. In this embodiment base 62, 63 is permanently affixed to the surfboard deck so said base will not be detachable or interchangeable with other bases.

Figure 28:
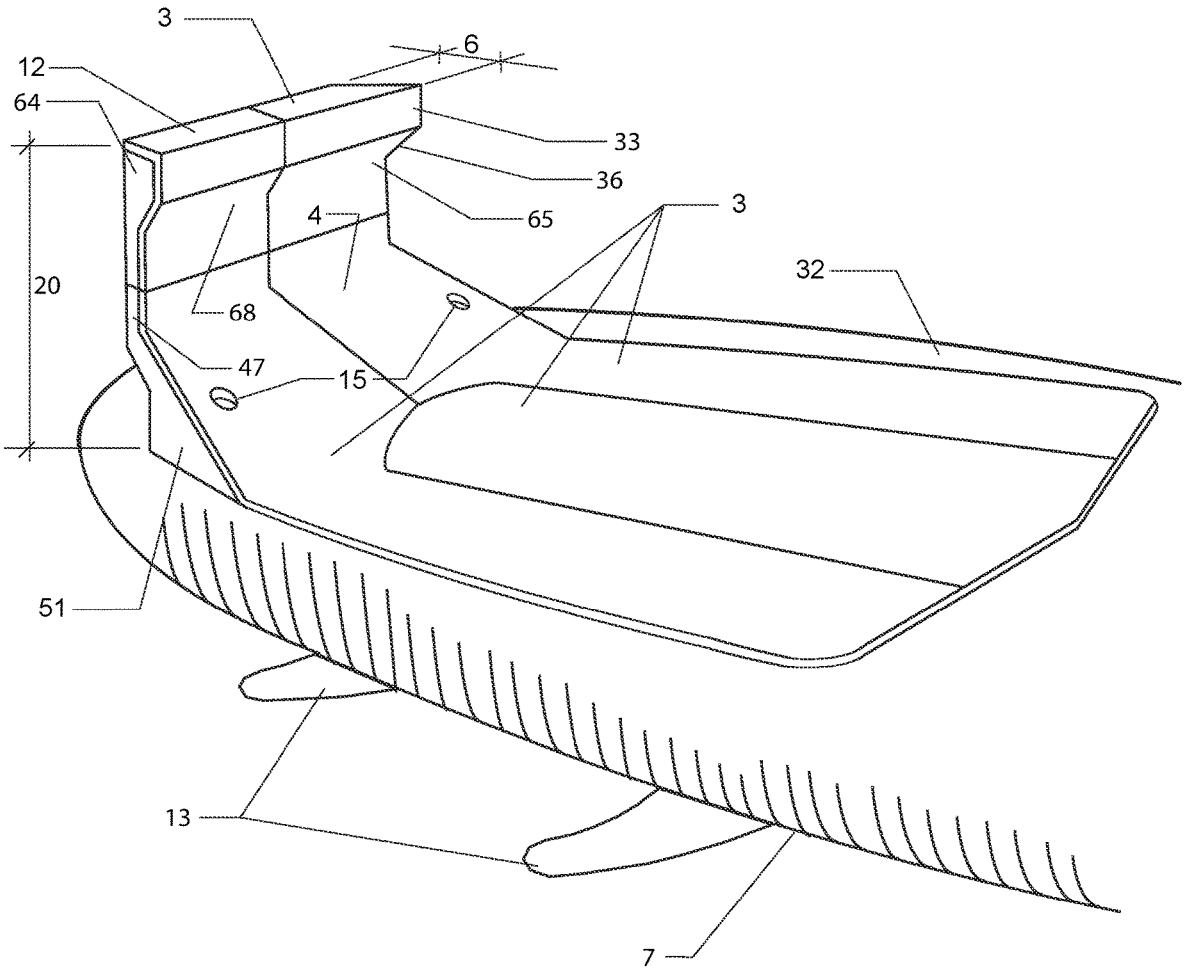
FIG. 28. is a perspective view of a surfboard 7 equipped with an enhanced surfboard traction pad with a two piece base 51, 52 featuring top pieces with an angular overhang 64, 65 and a five piece traction pad.

Referring to FIG. 28, a perspective view of a surfboard 7 is shown equipped with an enhanced surfboard traction pad with a two piece base 51, 52 featuring top pieces with an angular overhang 64, 65 and a five piece traction pad.

Figure 29:
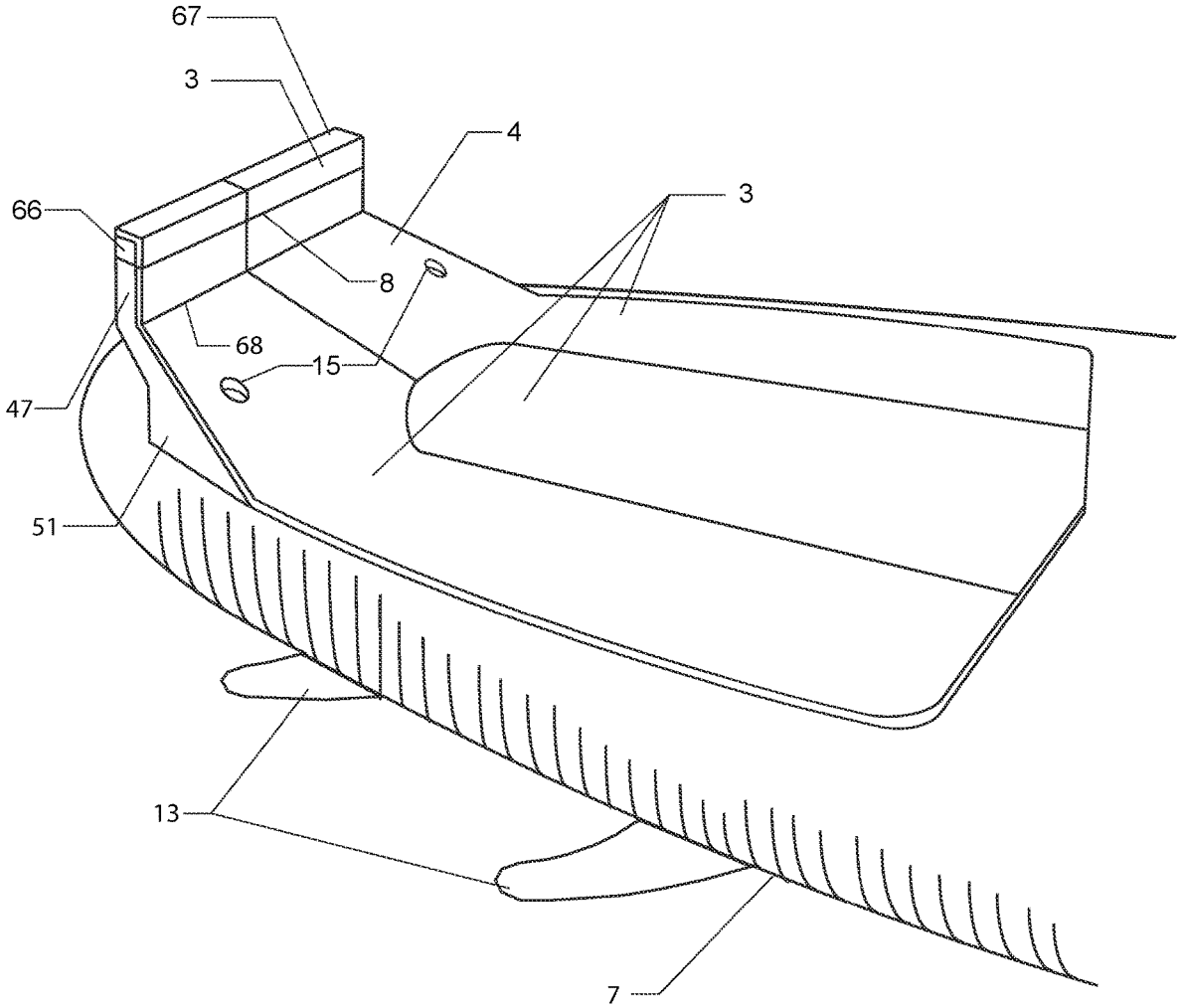
FIG. 29. is a perspective view of a surfboard 7 equipped with an enhanced surfboard traction pad with a two piece base 51, 52 featuring vertical top pieces 66, 67 and a five piece traction pad.

Referring to FIG. 29, a perspective view of a surfboard 7 is shown equipped with an enhanced surfboard traction pad with a two piece base 51, 52 featuring vertical top pieces 66, 67 and a five piece traction pad.

Figure 30:
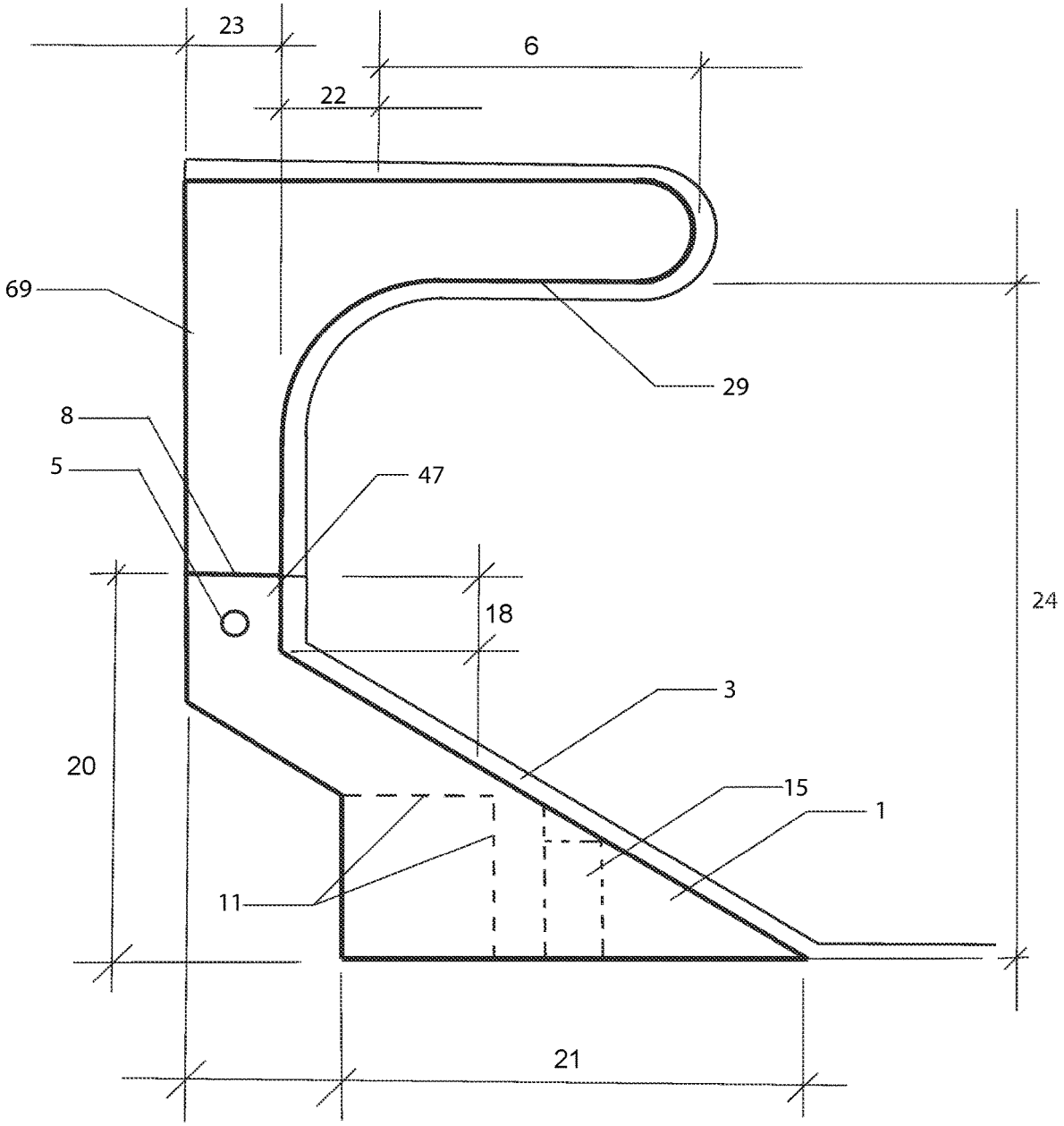
FIG. 30. is a side view of a base 1 with an interchangeable top piece 69 with a curved overhang going into a horizontal overhang.

Referring to FIG. 30, a side view is shown of base 1 with interchangeable top piece 69 with a curved overhang going into a horizontal overhang.

Figure 31:
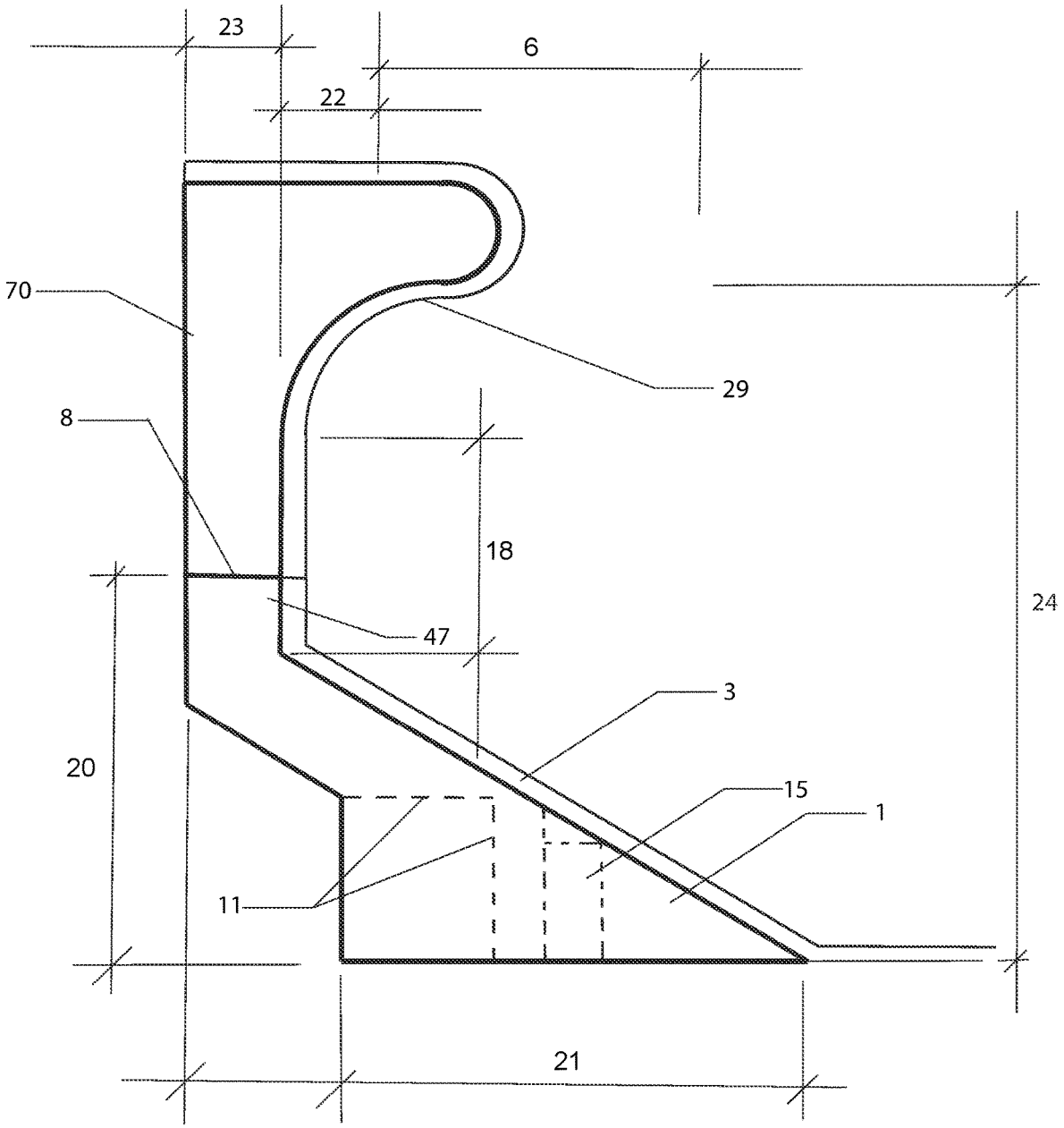
FIG. 31. is a side view of a base 1 with an interchangeable top piece 70 with a curved overhang.

Referring to FIG. 31, a side view is shown of base 1 with interchangeable top piece 70 with a curved overhang.

Figure 32:
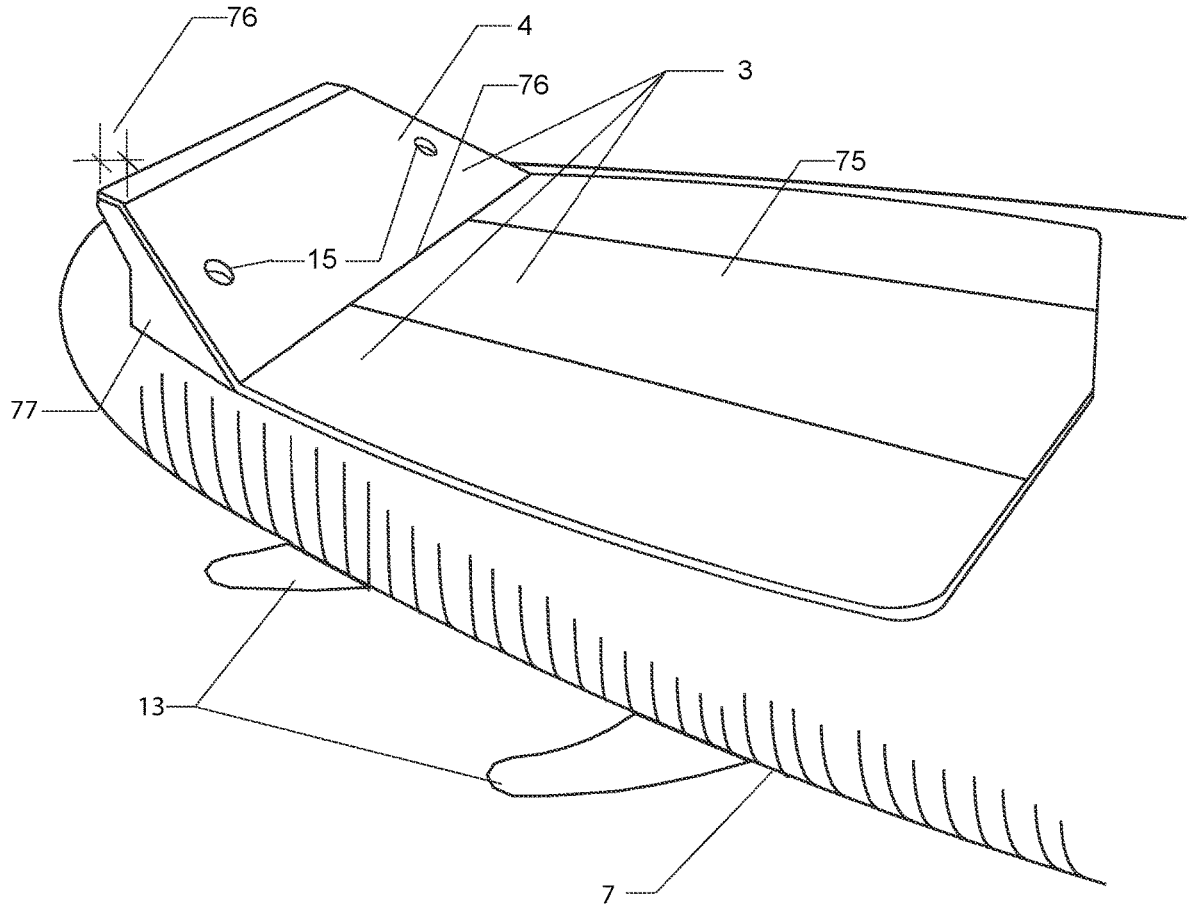
FIG. 32. is a perspective front view of a surfboard 7 equipped with an enhanced surfboard traction pad with a one piece base 77 with a ramp 4 going into a horizontal top.

Referring to FIG. 32, a perspective front view of a surfboard 7 is shown equipped with an enhanced surfboard traction pad with a one piece base 77 with a ramp 4 going into a horizontal top. This design is for surfers who prefer to not have a foot pocket area but like only a ramp to place rear their foot on.

Figure 33:
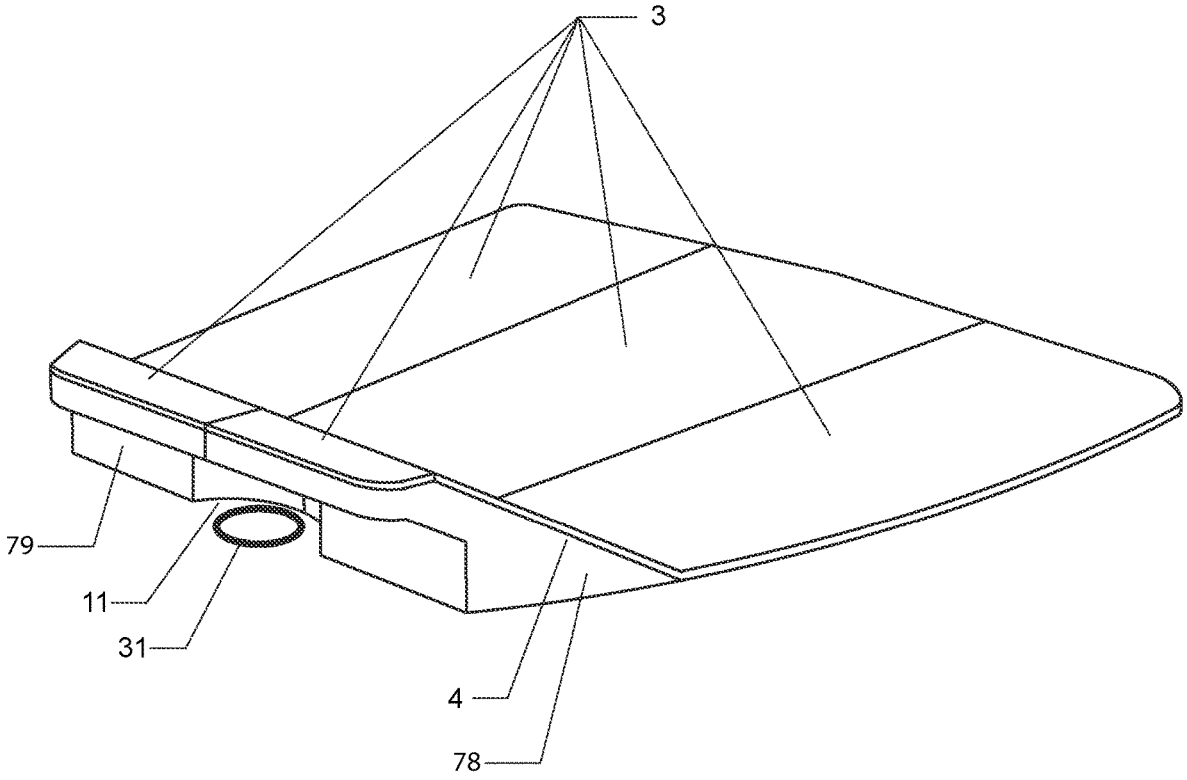
FIG. 33. is a perspective rear view of a surfboard 7 equipped with an enhanced surfboard traction pad with a two piece base 78 and a ramp 4 going into a horizontal top.

Referring to FIG. 33, a perspective rear view of a surfboard 7 is shown equipped with an enhanced surfboard traction pad with a five piece base 78 and a ramp 4 going into a horizontal top. This design is for surfers who prefer to not have a foot pocket area but like only a ramp to place rear their foot on.

Figure 34:
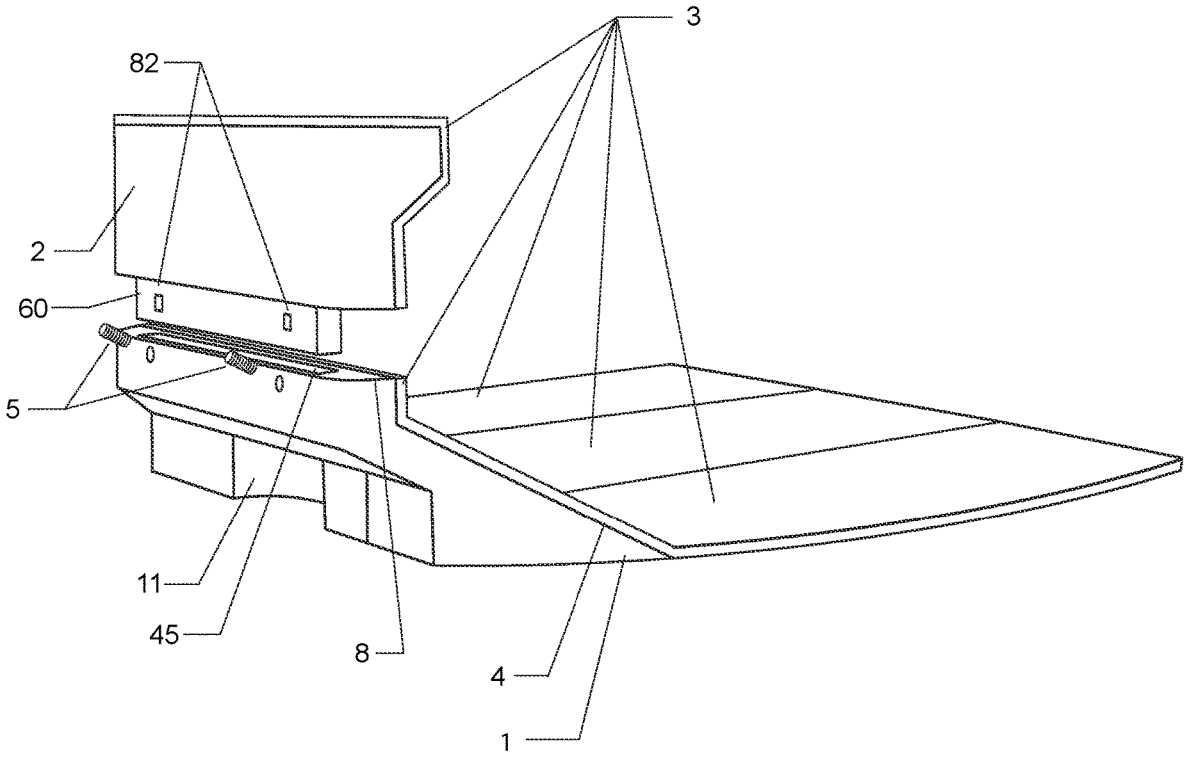
FIG. 34 is a perspective exploded rear view of a surfboard 7 is shown with a groove 45 in base 1 interlocking into a tongue 60 in top piece 2 secured by screws 5.

Referring to FIG. 34, a perspective exploded rear view of a surfboard 7 is shown with a groove in base 1 interlocking into a tongue 60 in top piece 2 secured by screws 5. Top piece 2 slides into groove 45 in base 1 with a snug fit so when secured by screw 5 the base 1 and top piece 2 do not move relative to each other. Said tongue and groove may need to be machined to achieve a precise fit.

Figure 35:
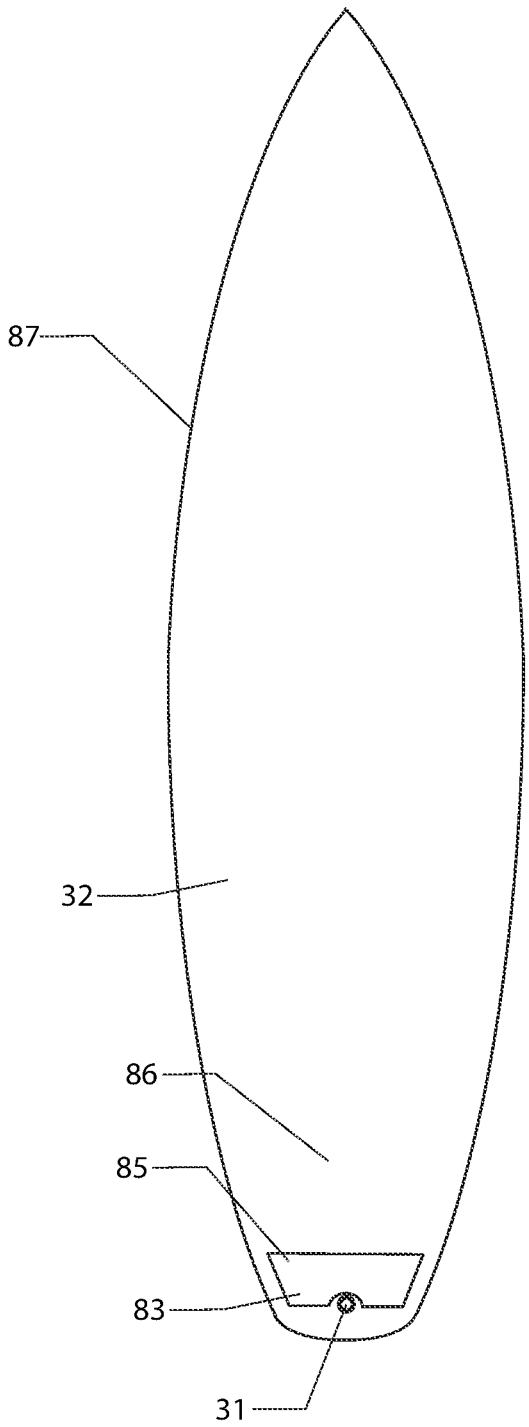
FIG. 35 is a top view of a surfboard 87 shown with mounting plate 83.

Referring to FIG. 35, a top view of a surfboard 87 specifically designed to accommodate an enhanced surfboard traction pad is shown with mounting plate 83. Said mounting plate and integrated barrel 84 can be made from any material with sufficient rigidity to secure the base 1, 27, 30, 38, 53, 54, 56, 57, 58, 62, 63, 77, 78, 79 when screws 39 are screwed into barrel 84. When configuring the enhanced surfboard traction pad, if a mounting plate 84 is used, the surfer has the option of utilizing interchangeable bases and/or top pieces to customize the setup of said traction pad. The flat area 85 where a mounting plate would be affixed is shown as well as the transition area 86 from a flat to a domed surfboard deck 32 surface.

Figure 36:
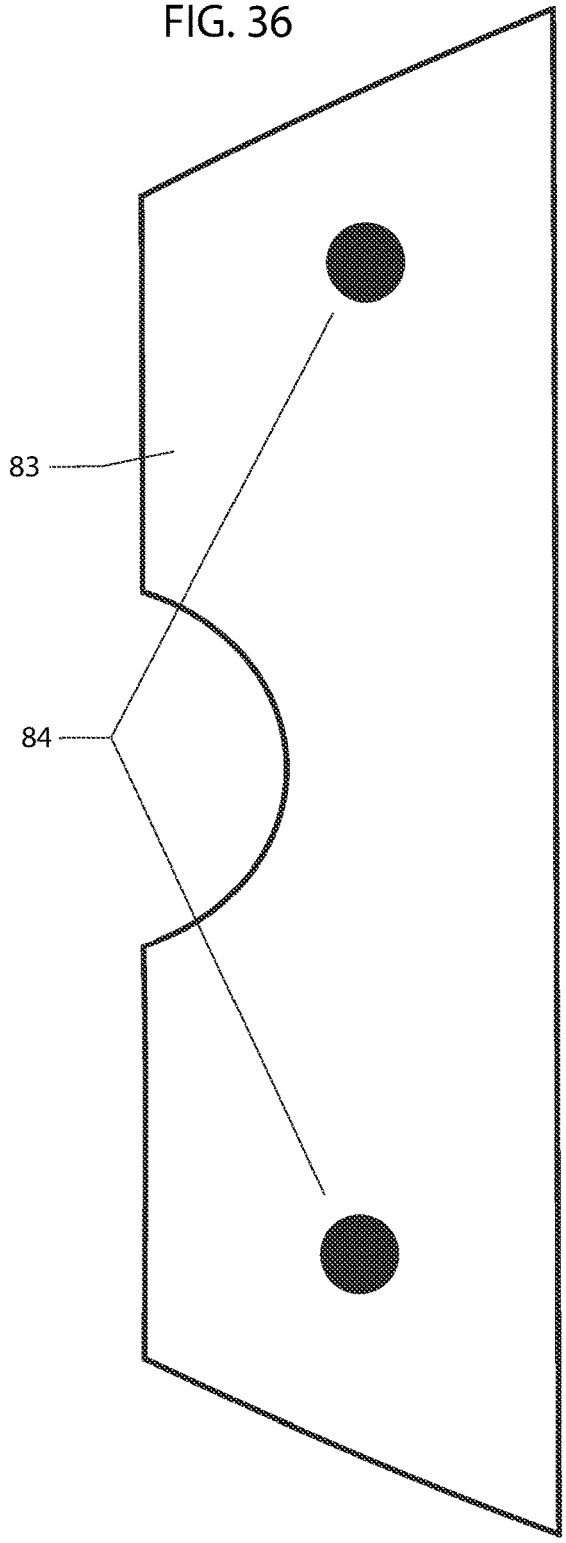
FIG. 36 is a top view of the mounting plate 83.

Referring to FIG. 36, a top view of the mounting plate 83 is shown.

Figure 37:
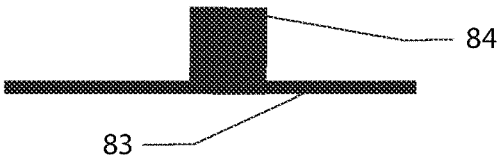
FIG. 37 is a side view of the mounting plate 83.

Referring to FIG. 37, a side view of the mounting plate 83 is shown. Screw 39 and barrel 84 size are to be optimum for securing base 1, 27, 30, 38, 53, 54, 56, 57, 58, 62, 63, 77, 78, 79 to mounting plate 83.

Figure 38:
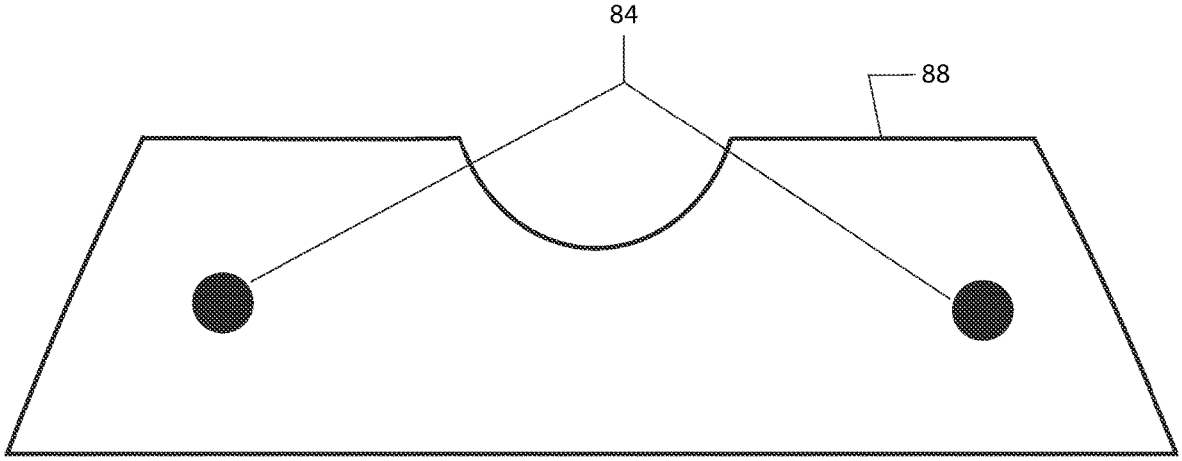
FIG. 38 is a top view of arched mounting plate 88.

Referring to FIG. 38, a top view of an arched mounting plate 88 is shown.

Figure 39:
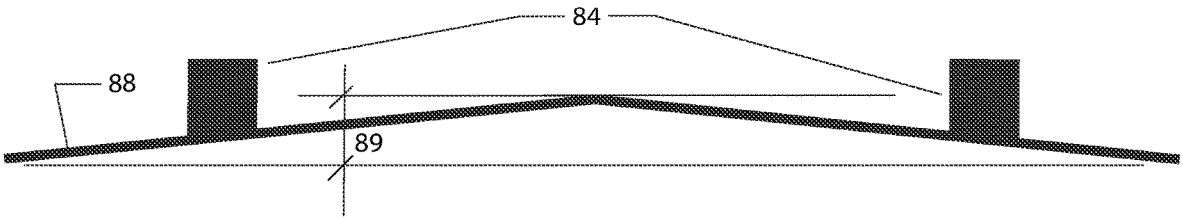
FIG. 39 is a front view of arched mounting plate 88.

Referring to FIG. 39, a front view of an arched mounting plate 88 is shown. The height of the arch can be any dimension suitable for mounting a base with matching arch to said mounting plate. Any base 1, 27, 30, 38, 53, 54, 56, 57, 58, 62, 63, 77, 78, 79 can have a flat bottom for mounting to mounting plate 83 or an arched bottom configured for a flush fit with whatever degree of arch is present in mounting plate 88 or the surfboard 87 deck.

Figure 40:
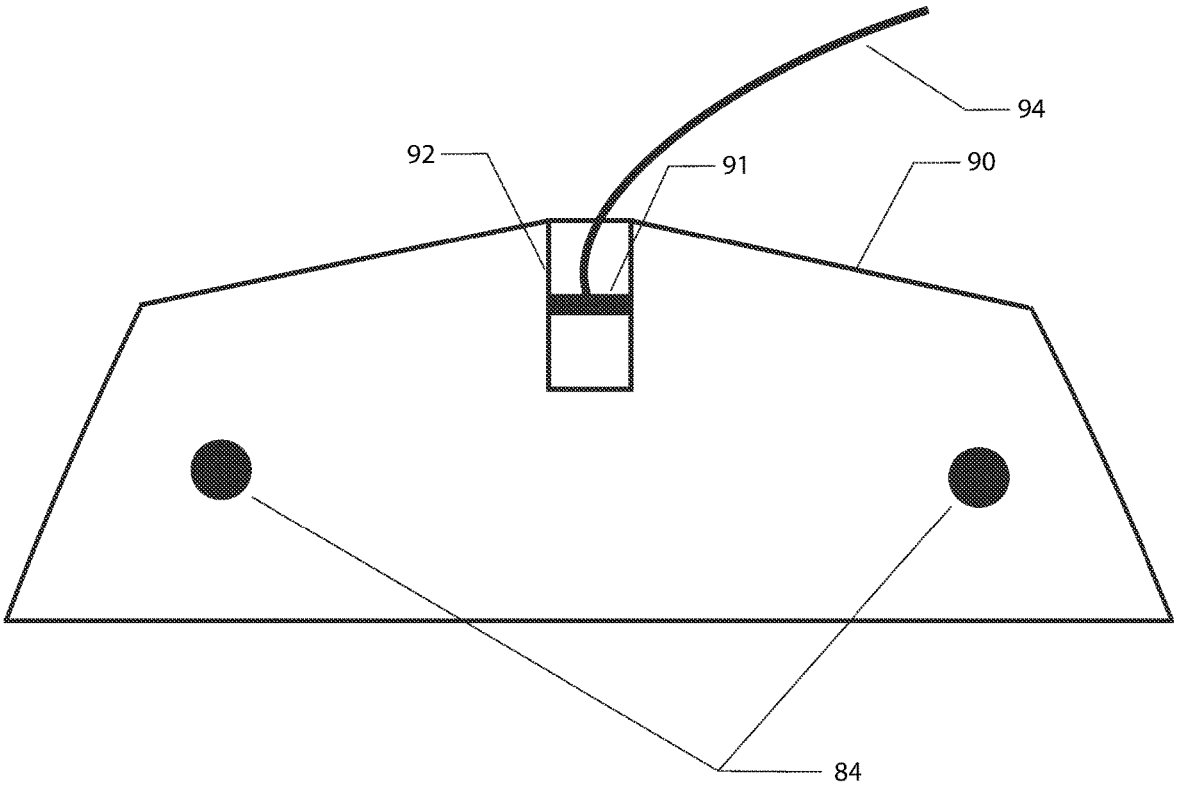
FIG. 40 is a top view of a flat mounting plate 90 with an integrated surfboard leash pin 91 and housing 92 for said leash pin 91.

Referring to FIG. 40, a top view of a flat mounting plate 90 with an integrated surfboard leash pin 91 and housing 92 for said leash pin 91 is shown. Having the leash pin 91 and housing 92 for said leash pin 91 integrated with the mounting plate 90 provides a very strong connection for the leash pin housing 92 and surfboard 87 and saves time in constructing the surfboard 87. Housing 92 for leash pin 91 is reinforced with extra material on side walls 93. Leash pin 91 is preferably made from stainless steel or any material with sufficient strength and resistance to corrosion from salt water to be able to withstand the force exerted by the surfboard leash 94 pulling on said leash pin 91 when a surfer falls of the board while surfing. Mounting plate may be arched or flat when integrated with a surfboard leash pin 91 and housing 92 for said leash pin 91.

Figure 41:
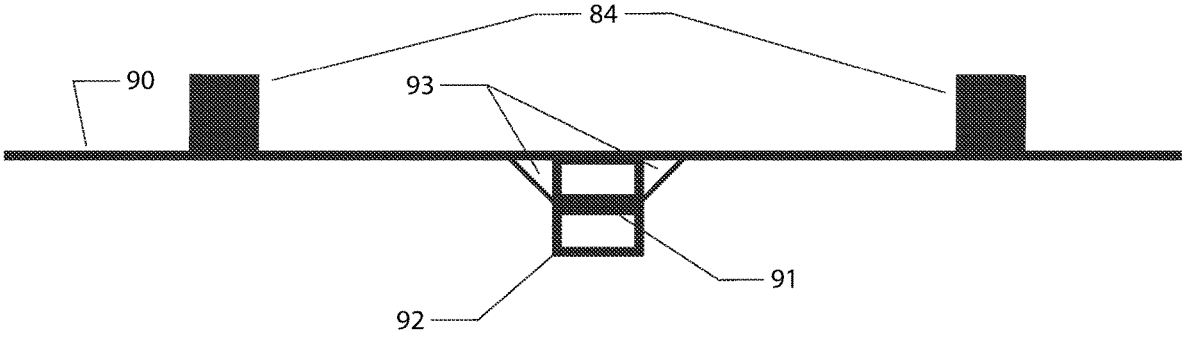
FIG. 41 is a front view of a flat mounting plate 90 with an integrated surfboard leash pin 91 and housing 92 for said leash pin 91.

Referring to FIG. 41, a front view of a flat mounting plate 90 with an integrated surfboard leash pin 91 and housing 92 for said leash pin 91 is shown.

Figure 42:
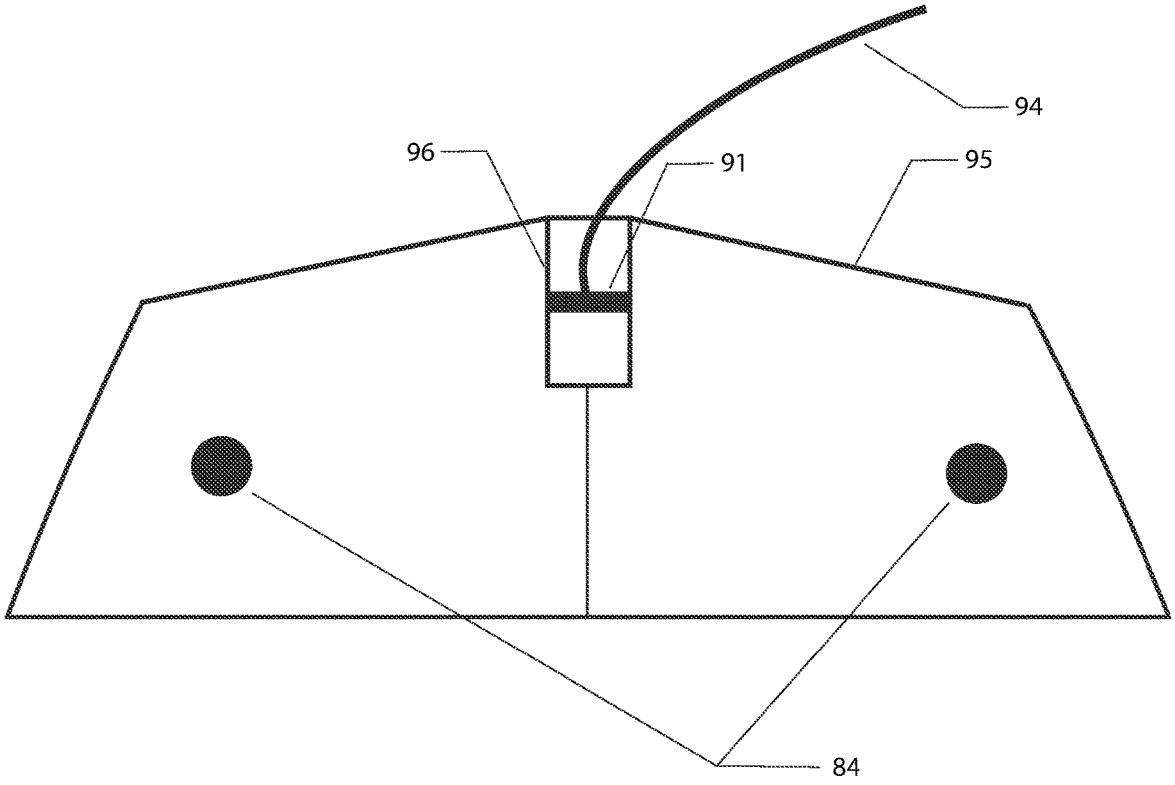
FIG. 42 is a top view of an arched mounting plate 95 with an integrated surfboard leash pin 91 and housing 96 for said leash pin 91.

Referring to FIG. 42, a top view of an arched mounting plate 95 with an integrated surfboard leash pin 91 and housing 96 for said leash pin 91 is shown.

Figure 43:
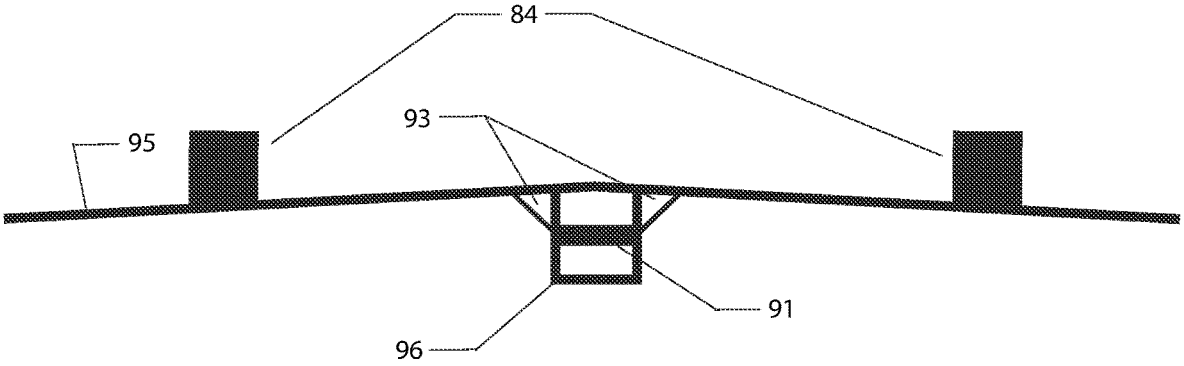
FIG. 43 is a front view of an arched mounting plate 95 with an integrated surfboard leash pin 91 and housing 96 for said leash pin 91.

Referring to FIG. 43, a front view of an arched mounting plate 95 with an integrated surfboard leash pin 91 and housing 96 for said leash pin 91 is shown.

Figure 44:
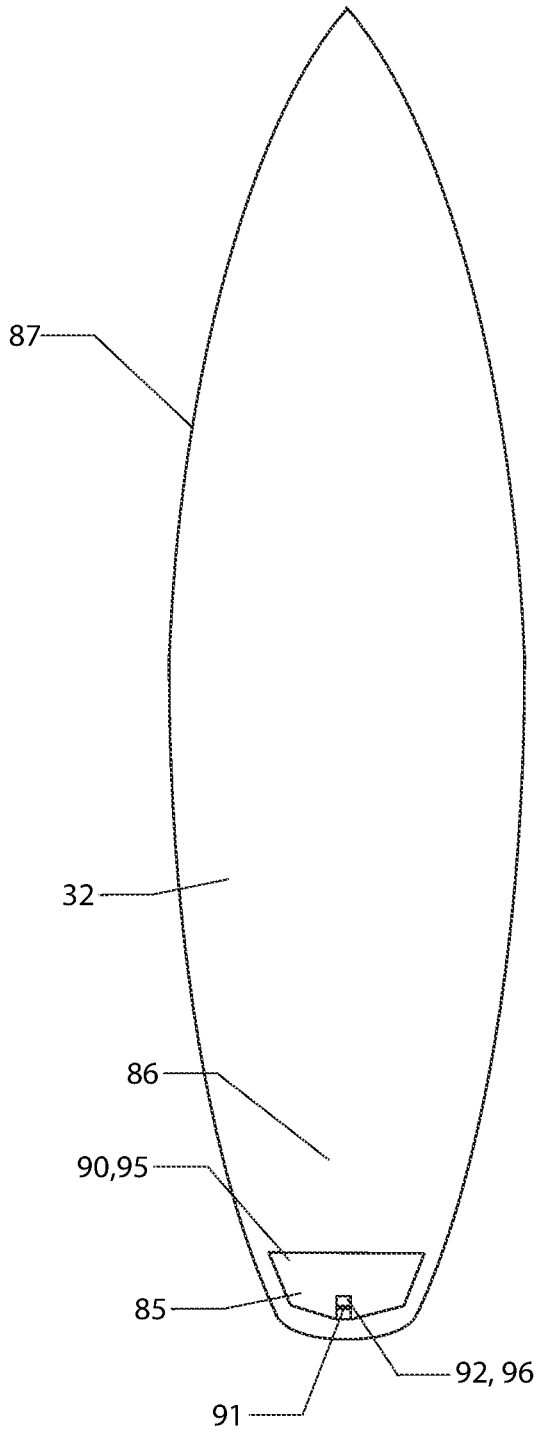
FIG. 44 is a top view of a surfboard 87 shown with mounting plate 90, 95 with integrated surfboard leash pin housing and leash pin.

Referring to FIG. 44, a top view of a surfboard 87 shown with mounting plate 90, 95 with integrated surfboard leash pin housing and leash pin.

GLOSSARY OF NUMBERED DESCRIPTIONS

1 Base for attaching top pieces
2 Top piece with horizontal overhang
3 Traction pad material
4 Traction pad foot ramp
5 Screw for attaching top piece.
6 Overhang can be any length
7 Regular surfboard with domed deck
8 Possible location of join line between base and top piece
9 Traction pad material
Surfers left (rear) foot (goofy foot stance)
11 Leash pin cut-out
12 Advertising area for logo and branding
13 Surfboard fins
14 Overhang
15 Mounting holes
16 One piece traction pad
17 Top piece with angled overhang
18 Vertical front of enhanced traction pad can be any length
19 Base vertical section
20 Height of base with or without detachable top piece can be any length
21 Width of base can be any length
22 Width of angled area to horizontal overhang can be any length
23 Thickness of vertical portion of base can be any length
24 Distance from bottom of base to underside of overhang can be any length
25 Distance base goes back behind leash pin can be any length
26 Angled screw shaft for securing top piece to base
27 Left traction pad base, vertical without a top piece with arched ramp
28 Vertical rise of one piece base with no overhang can be any length
29 Horizontal Overhang
30 One piece traction pad base with vertical face
31 Surfboard leash pin hole
32 Surfboard deck
33 Vertical front of angled overhang
34 Top piece with angled overhang
35 Ankle cut-out
36 Angular overhang
37 Surfers right (Rear) foot (regular foot stance)
38 One piece base with angled overhang
39 Mounting screws
40 Angled ankle cut out
41 Curved ankle cut out
42 Curved ankle cut out
43 Angled ankle cut out
44 Pin for securing left side of top piece
45 Groove for top piece and base to connect
46 Horizontal screw shaft for securing top piece to base
47 Vertical front of base at top of ramp
48 Arched ramp
49 Left top piece with horizontal overhang
50 Right top piece with horizontal overhang
51 Left traction pad base for attaching for top pieces
52 Right traction pad base for attaching top pieces
53 Left traction pad base, vertical without a top piece
54 Right traction pad base, vertical without a top piece
55 Arch rise on arched ramp
56 Left one piece traction pad base with horizontal overhang
57 Right one piece traction pad base with horizontal overhang
58 One piece traction pad base with horizontal overhang
59 Top piece cap with vertical face
60 Connecting tongue for top piece
61 Arched base bottom
62 Left base with angled overhang
63 Right base with angled overhang
64 Left top piece with angled overhang
65 Right top piece with angled overhang
66 Left vertical top piece
67 Right vertical top piece
68 Foot pocket area
69 Top piece with curved+horizontal overhang
70 Top piece with curved overhang
71 Top piece with angled+horizontal overhang
72 Notch for interlocking with pin in base
73 Notch for interlocking with screw through base
74 Traction pad material cut line
75 Arched traction pad
76 Horizontal top can be any width
77 One piece base with ramp to horizontal top
78 Left base with ramp to horizontal top
79 Right base with ramp to horizontal top
80 Single Piece traction pad for base to surfboard deck attachment
81 Multiple piece traction pad for base to surfboard deck attachment
82 Notch for securing top piece to base with screw
83 Hat mounting plate enhanced surfboard traction pad base
84 Upward barrel in surfboard mounting plate for screwing in mounting bolts
85 Hat or arched area in surfboard for mounting enhanced surfboard traction pad base and mounting plate

86 Transition area in surfboard going from flat to domed deck surface
87 New and unique shape of a surfboard with flat area for installing mounting plate
88 Arched mounting plate for surfboard traction pad base
89 Mounting plate and base arch can be any height
90 Hat Mounting plate integrated with leash pin and leash pin housing for surfboard traction pad base
91 Leash pin
92 Leash pin housing for integration with flat mounting plate
93 Reinforcing material for leash pin housing
94 Surfboard leash
95 Arched mounting plate integrated with leash pin and leash pin housing for surfboard traction pad base
96 Leash pin housing for integration with arched mounting plate

The invention claimed is:

1. An enhanced surfboard and surfboard traction pad comprising: a base which has one piece 27, 30, 38, 58, 77 or a one piece base 1 with detachable top pieces 2, 34, 59 that are interchangeable, or a two piece base with a horizontal overhang 56, 57 a vertical face 53, 54, an angled overhang 62, 63 or a ramp going into a horizontal back 78, 79 or a two piece base 51, 52 with interchangeable, detachable top pieces 49, 50, 64, 65, 66, 67, with traction pad material affixed to the front of said bases 1, 27, 30, 38, 53, 54, 56, 57, 58, 62, 63, 77, 78, 79 and top pieces 2, 34, 49, 50, 59, 64, 65, 66, 67 with said traction pad material extending forward from the base towards the nose of the surfboard 7, 87 and affixed to the surfboard 7, 87 with adhesive, and a surfboard shaped for optimal mounting of said enhanced traction pad bases.

2. The enhanced surfboard traction pad of claim 1 has a base 1, 27, 30, 51, 52, 53, 54, 56, 57, 62, 63, 77, 78, 79 that is unique in that it extends up, over and behind the leash pin hole 31 in the surfboard 7, 87, allowing the ramp area 4 of the base, and the vertical face of the base 47 starting at the top of the ramp, and the pocket for the surfer's rear foot 68 created by said ramp and vertical face of base 47 which abuts the outside and/or bottom of the surfer's rear foot while surfing to be behind the leash pin hole 31 in the surfboard deck so that the outside edge of the surfer's rear foot can be placed behind the leash pin hole in the surfboard, allowing the surfer to execute sharper turns.

3. The enhanced surfboard traction pad of claim 1 is configured with a one 38, 58, or two 56, 57, 62, 63, piece base with an angled 38, 62, 63 or horizontal 58, 56, 57 or curved 69, 70, 71 overhang, or base 1 and one-piece interchangeable top pieces 2, 34, 70, 71 with an overhang that can be curved 70, 71, angled 34, or horizontal 2, of sufficient length to create a pocket for the surfer's rear foot 68 which allows said foot to maintain a secure point of contact with the surfboard between the bottom, outside edge, and/or top of the foot, so said foot does not become disengaged with the surfboard while attempting to push the tail end of the surfboard back with the side of said foot and/or lift the tail end of the surfboard up with the top of said foot when surfing a wave.

4. The enhanced surfboard traction pad of claim 1 is configured with a one piece base 30 or base 1 and interchangeable top piece with a vertical face 59 or a two piece base 51, 52 and interchangeable vertical top pieces 66, 67 or a two piece base with vertical face 53, 54 of sufficient length to create a pocket for the surfer's rear foot 68 which allows said foot to maintain a secure point of contact with the surfboard between the bottom and outside edge of the foot, so said foot does not become disengaged with the surfboard while attempting to push the tail end of the surfboard back or up with the side of said foot when surfing a wave.

5. The enhanced surfboard traction pad of claim 1 is manufactured in different sizes and heights 6, 18, 20, 21, 22, 23 for structural integrity, functionality, and so a surfer's rear foot of any size can reside in the foot pocket area created by the vertical back and any combination of an angular, curved or horizontal overhang and feel comfortable with optimum clearance between the top of said foot and the bottom of the overhang so the surfer can maintain a secure point of contact with the surfboard and push the tail of the surfboard back with the side of said foot and/or lift the tail end of the surfboard up with the top of said foot and have an ankle cut out 35, 40, 41, 42, 43 so designed to allow the surfer's rear foot to have freedom of movement without being constrained by said overhang and also so that the surfer's rear foot can come out of the foot pocket area easily if and when the surfer falls off of the surfboard when riding a wave.

6. The enhanced surfboard traction pad of claim 1, wherein the base and top pieces referred to in claim 1 is comprised of foam layers glued together, molded foam, nylon or plastic of any color or any material having optimum flex and rigidity which will retain it's form while pressure from the surfer's rear foot pushes against the back of the foot pocket area 68, or lifting against the underside of the foot pocket area with pressure from the top of the said foot, and additionally have a cut-out area 11 on the rear so the base referred to in claim 1 is located further back without covering the surfboard leash pin hole 31.

7. The enhanced surfboard traction pad of claim 1, wherein the traction pad material 3 comprising EVA rubber foam or some other suitable material, has a surface optimized for making it easy to grip with the surfer's foot without slipping and is permanently affixed to the front of the base 1, 27, 30, 38, 58, 51, 52, 56, 57, 62, 63, 77, 78, 79 underside of the overhang 29, 36, and top side of said base 12, 27, 30, 53, 54, 56, 57 and top piece 2, 34, 49, 50, 59, 64, 65 with adhesive, extends forward past the front of said base towards the nose of the surfboard, affixed to the surfboard with adhesive, as far as is needed to provide optimum traction for the surfers rear foot while surfing, said traction pad material 3 is contiguous and go from the surfboard deck 32, up the ramp 4 of any base or be cut at the front of the base 74 to allow for the base to be easily detached and interchanged with other bases.

8. The enhanced surfboard traction pad of claim 1, wherein the traction pad material 3 may be different for the base than for the top piece, and may different for the center piece than the sides and may be different from piece to piece anywhere in any manner including having an area arched or flattened for a logo to be affixed or imprinted and traction pad bases and top pieces and traction pad material 3 can be in any color or combination of colors.

9. The enhanced surfboard traction pad of claim 1 is designed to form a traction pad surface for the surfer to stand on while surfing, and for creating a secure point of contact for the surfer's rear foot while in the foot pocket area 68 between the ramp 4 and vertical section 28, 47 and/or under the overhang 29 which allows said rear foot to maintain a secure point of contact with the surfboard between the bottom and outside edge of the foot, so said foot does not become disengaged with the surfboard while attempting to push the tail end of the surfboard back or up with the side of said foot when surfing a wave.

10. The enhanced surfboard traction pad of claim 1 base 1, 27, 30, 38, 51, 52, 53, 54, 56, 57, 58, 77, 78, 79 and top pieces 2, 34, 49, 50, 59, 64, 65, 66, 67 are uniquely designed to display a product name, and/or an advertising message with or without a logo on the back vertical space and/or top horizontal space 12 with said product name, logo and/or advertising message optionally molded, carved and/or stamped with permanent ink on the horizontal or vertical faces 12 of said base and top pieces, or the product name, and/or an advertising message with or without a logo may be displayed with a separate piece of material affixed to said vertical face or horizontal face 12 with adhesive.

11. The enhanced surfboard traction pad of claim 1 is secured to the surfboard deck 32 with adhesive between the bottom of said traction pad and the surfboard deck strong enough to permanently bond said traction pad to said surfboard 7 deck, with said surfboard deck being suitably prepared by sanding, planing or initial shaping of the surfboard 87 to create a flat or flat and angled surface area that will match the bottom of the base(s) of said traction pad so said traction pad shall mount flush onto said surfboard deck so said adhesive will have maximum surface area to bond said traction pad to said surfboard deck 32.

12. The enhanced surfboard traction pad of claim 1 is configured to comprise detachable and interchangeable top pieces 2, 34, 49, 50, 59, 64, 65, 66, 67 constructed with a tongue 60 which slides into a groove 45 in the top of the base 1, 51, 52, and are secured with screws 5 through a threaded shaft in the back of said base horizontally 46 or at an angle 26 that screw into a notch 82 into said top piece tongue 60.

13. The enhanced surfboard traction pad of claim 1 is configured with a base 61 that is arched in the center on the bottom to aid in mounting to surfboard decks with an arched center, and furthermore said bottom of base can be flat, arched and configured with any shape, size, angle, curvature or combination angles that optimizes mounting to the deck of the surfboard with adhesive which can be strong enough to permanently affix said traction pad to the surfboard deck with or without mounting bolts 39.

14. Traction pad material 3 is configured to have a cut line 74 at the bottom of the ramp so any of the base options may be permanently affixed to the surfboard deck with adhesive, while the traction pad material that extends forward may be a separate piece and easily removed and replaced if worn, or in embodiments where the traction pad base is mounted to a mounting plate 83 and said base is detachable and interchangeable with other bases, said base can be easily removed for swapping with other bases while the traction pad material affixed to the surfboard deck 32 remains undisturbed.

15. The enhanced surfboard traction pad of claim 1 is configured with a flat or arched ramp area 48, and traction pad material 3 affixed to the surfboard deck may provide an arch 75 for the surfer's foot or be flat.

16. The enhanced surfboard traction pad of claim 1 has a one 77 or two 78 piece base that extends up, over and behind the surfboard leash pin hole 31 with a ramp 4 to a horizontal top of any length or width.

17. The enhanced surfboard traction pad of claim 1 base 1, 27, 30, 38, 51, 52, 53, 54, 56, 57, 58, 62, 63, 77, 78, 79 is permanently affixed to the surfboard deck 32 with adhesive or is detachable and interchangeable using a flat 83 or arched 88 mounting plate which is permanently affixed to the surfboard deck with upward facing threaded barrels 84 which are inserted through mounting holes 15 in the enhanced surfboard traction pad base 1, 27, 30, 38, 51, 52, 53, 54, 56, 57, 58, 62, 63, 77, 78, 79 through which screws 39 are screwed from the top of said base into said barrel 84 to secure said base to the mounting plate 83.

18. The enhanced surfboard traction pad of claim 1 base is configured with a flat 1 or arched 61 bottom for mounting to a flat 83 or arched 88 mounting plate or a surfboard 87 deck shaped with a flat or arched mounting area 85 and a flat 90 or arched 95 mounting plate with an integrated surfboard leash pin 91 and housing 92, 96 for said leash pin 91.

19. The enhanced surfboard of claim 1 comprises a new and unique shape of surfboard 87 with an area 85 configured for installing a flat or arched bottom enhanced surfboard traction pad or a flat 83 or arched 88 bottom mounting plate, or a flat 90 or arched 95 bottom mounting plate with integrated leash pin housing 92, 96 and leash pin 91 in said surfboard deck.

20. The enhanced surfboard traction pad of claim 1 is unique in that it is the first traction pad to have permanently mounted or interchangeable bases 1, 27, 30, 38, 51, 52, 53, 54, 56, 57, 58, 62, 63, 77, 78, 79 that extend up, over and behind the leash pin hole 31 in a surfboard, the first traction pad comprising interchangeable top pieces 2, 34, 49, 50, 59, 64, 65, 66, 67, the first traction pad with a wide ramp area 4 for the surfer to stand on, the first traction pad to integrate with a new design of surfboard with a flat or arched area 85 for installing a flat or arched bottomed enhanced traction pad or a flat 83 or arched 88 mounting plate in said surfboard deck, the first traction pad to integrate a flat 90 or arched 95 mounting plate with a leash pin housing 92, 96 and leash pin 91, and the first traction pad to make a significant difference in helping surfers execute aerial maneuvers while surfing.

* * * * *